US012251787B2

(12) United States Patent
Zuniga et al.

(10) Patent No.: US 12,251,787 B2
(45) Date of Patent: Mar. 18, 2025

(54) MODULAR CHEMICAL MECHANICAL POLISHER WITH SIMULTANEOUS POLISHING AND PAD TREATMENT

(71) Applicant: Applied Materials, Inc., Santa Clara, CA (US)

(72) Inventors: Steven M. Zuniga, Soquel, CA (US); Jay Gurusamy, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 320 days.

(21) Appl. No.: 17/979,850

(22) Filed: Nov. 3, 2022

(65) Prior Publication Data

US 2024/0075582 A1 Mar. 7, 2024

Related U.S. Application Data

(60) Provisional application No. 63/403,269, filed on Sep. 1, 2022.

(51) Int. Cl.

| | |
|---|---|
| ***B24B 37/10*** | (2012.01) |
| ***B24B 37/20*** | (2012.01) |
| ***B24B 41/02*** | (2006.01) |
| ***B24B 47/02*** | (2006.01) |
| ***B24B 53/017*** | (2012.01) |

(52) U.S. Cl.

CPC ..... *B24B 37/105* (2013.01); *B24B 37/20* (2013.01); *B24B 41/02* (2013.01); *B24B 47/02* (2013.01); *B24B 53/017* (2013.01)

(58) Field of Classification Search

CPC ... B24B 27/0076; B24B 37/105; B24B 37/20; B24B 37/345; B24B 37/30; B24B 37/04; B24B 41/02; B24B 41/005; B24B 47/02; B24B 53/017; B24B 19/22; B24B 19/226

USPC ..... 451/41, 56, 285, 287, 443

See application file for complete search history.

(56) References Cited

U.S. PATENT DOCUMENTS 5,554,065 A * 9/1996 Clover ..... B24B 27/0023 451/283
6,186,877 B1 * 2/2001 Lofaro ..... B24B 37/345 451/288
6,491,570 B1 * 12/2002 Sommer ..... B24B 37/20 451/388

(Continued)

FOREIGN PATENT DOCUMENTS

KP 1020190011895 A 2/2019

OTHER PUBLICATIONS

International Search Report/ Written Opinion issued to PCT/US2023/030348 on Dec. 6, 2023.

*Primary Examiner* — Robert F Neibaur
(74) *Attorney, Agent, or Firm* — Patterson + Sheridan, LLP

(57) ABSTRACT

The present disclosure is directed towards polishing modules for performing chemical mechanical polishing of a substrate. The substrate may be a semiconductor substrate. The polishing modules described have a plurality of pads, such as polishing pads, disposed within a single polishing station. The pads are configured to remain stationary during processing, such as during polishing or buff operations. Either an x-y gantry assembly or a head actuation assembly is coupled to a system body of a polishing module and is configured to move a carrier head over the pads. Between process operations the polishing pads may be indexed to expose a new polishing pad to the carrier head.

11 Claims, 17 Drawing Sheets

(56) References Cited

U.S. PATENT DOCUMENTS

| | | | | |
|---|---|---|---|---|
| 6,554,688 | B2 * | 4/2003 | Lacy | B24B 53/10 451/72 |
| 2014/0020830 | A1 | 1/2014 | Rangarajan et al. | |
| 2015/0105005 | A1 | 4/2015 | Zuniga et al. | |
| 2020/0114487 | A1 | 4/2020 | Butterfield et al. | |
| 2021/0323117 | A1 | 10/2021 | Rangarajan et al. | |

* cited by examiner

MODULAR CHEMICAL MECHANICAL POLISHER WITH SIMULTANEOUS POLISHING AND PAD TREATMENT

CROSS-REFERENCE TO RELATED APPLICATION(S)

The present Application claims the benefit of U.S. Provisional Patent Application No. 63/403,269, filed Sep. 1, 2022, which is hereby incorporated by reference herein in its entirety.

BACKGROUND

Field

Embodiments described herein generally relate to equipment used in the manufacturing of electronic devices, and more particularly, to a modular chemical mechanical polishing (CMP) system which may be used to polish or planarize the surface of a substrate in a semiconductor device manufacturing process.

Description of the Related Art

Chemical mechanical polishing (CMP) is commonly used in the manufacturing of high-density integrated circuits to planarize or polish a layer of material deposited on a substrate. In a typical CMP process, a substrate is retained in a carrier head that presses the backside of the substrate towards a polishing pad secured to a surface of a rotating platen. Material is removed across the material layer surface of the substrate in contact with the polishing pad through a combination of chemical and mechanical activity which is provided by a polishing fluid and a relative motion of the substrate and the polishing pad. Typically, after one or more CMP processes are complete a polished substrate will be further processed to one or a more post-CMP substrate processing operations. For example the polished substrate may be further processed using one or a combination of cleaning, inspection, and measurement operations. Once the post-CMP operations are complete a substrate can be sent out of a CMP processing area to the next device manufacturing process, such as a lithography, etch, or deposition process.

To conserve valuable manufacturing floor space and reduce labor costs, a CMP system will commonly include a first portion, e.g., a back portion, comprising a plurality of polishing stations and a second portion, e.g., a front portion which has been integrated with the first portion to from a single polishing system. The first portion may comprise one or a combination of post-CMP cleaning, inspection, and/or pre or post-CMP metrology stations. Often the first portion of a CMP system can be customized during the fabrication thereof to more particularly address the needs of specific equipment customers.

The first portion of conventional CMP systems are often too complex and take up too much valuable manufacturing floor space for their maximum substrate throughput. One reason for poor throughput is polishing processes are halted during processes used to clean and/or recondition a polishing pad after multiple polishing processes are performed thereon. However, if adequate cleaning and/or recondition time is not provided, defect levels on the substrate have been found to increase due to cross-contamination and polishing defect concerns. Therefore, the cleaning and/or recondition time limits the total throughput of substrates through the CMP system. Thus, the throughput density (i.e., number of substrates processed per unit time per unit area of manufacturing floor space) of a CMP system will be undesirably limited by the performance cleaning and/or reconditioning processes, which limits the number of available polishing modules in a standard CMP system configuration for processing.

Accordingly, what is needed in the art are modular polishing systems with improved substrate throughput density and is able to solve the problems described herein.

SUMMARY

The present disclosure is generally related to chemical mechanical polishing (CMP) modules and customizable high throughput density modular CMP systems comprised thereof. Embodiments herein are directed to modular polishing systems composed of stacked polishing modules that provide for increased system throughput density and improved reliability when compared to conventional polishing systems.

Embodiments of the disclosure include a substrate polishing system, comprising a plurality of polishing stations that are positioned in a stacked orientation. Each of the polishing stations include a system body that includes one or more walls that define a processing region, a platen, and a head assembly. The platen is disposed within the processing region of the system body and has a rectangular pad supporting surface that is configured to receive a non-axisymmetric polishing pad, wherein a long side of the rectangular pad supporting surface is aligned in a first direction. The head assembly is disposed over the pad supporting surface of the platen. The head assembly comprises a carrier head disposed over the pad supporting surface of the platen, a linear actuator connected to a central rail support, and a support arm that couples the carrier head to the linear actuator, wherein the linear actuator is configured to position the carrier head and support arm in the first direction. Implementations may include one or more of the following features. The substrate polishing system where the linear actuator is the only means to generate relative motion between the carrier head and a non-axisymmetric polishing pad disposed on the rectangular pad supporting surface. Implementations of the described techniques may include hardware, a method or process, or computer software on a computer-accessible medium.

One general aspect of the disclosure includes a substrate polishing system. The substrate polishing system also includes a system body that includes one or more walls that define a processing region. The system also includes a first platen disposed in the processing region of the system body. The system also includes a second platen disposed in the processing region of the system body. The system also includes a central rail support disposed between the first platen and the second platen and within the processing region of the system body. The system also includes a first head assembly disposed above one of the first platen or the second platen may include: a first carrier head, and a first support arm coupling the first carrier head to the central rail support, a second head assembly disposed above one of the first platen or the second platen may include: a second carrier head, and a second support arm coupling the second carrier head to the central rail support.

Embodiments of the disclosure may further include a substrate polishing system, comprising a plurality of polishing stations that are positioned in a stacked orientation. The substrate polishing system can include a first polishing station that is configured to be positioned over a second polishing station. Each of the polishing stations include a system body that includes one or more walls that define a processing region, a platen, and a head assembly. The platen is disposed within the processing region of the system body and has a rectangular top surface. The head assembly is disposed over the platen. An x-y gantry assembly is disposed over the platen and configured to actuate both of the head assembly and the slurry module in an x-direction and a y-direction in one or more pre-determined patterns while the platen remained in a first position. The system can further include a pad conditioner.

Embodiments of the disclosure may further include a polishing station, configured for use during semiconductor manufacturing. The polishing station includes a first polishing module that includes a system body that includes one or more walls that define a processing region, a first platen disposed within the processing region of the system body, a second platen disposed within the processing region of the system body, a carrier head within the processing region of the system body, and an x-y gantry assembly disposed over the first and second platens and configured to actuate the carrier head in an x-direction and a y-direction in one or more pre-determined patterns while the first and second platens both remain in a fixed position relative to the system body. The system can further include one or more pad conditioners within the processing region of the system body.

Embodiments of the disclosure may further include a polishing station, configured for use during semiconductor manufacturing. The polishing station includes: a system body that includes one or more walls that define a processing region; a first platen disposed in the processing region of the system body; a second platen disposed in the processing region of the system body; a central rail support disposed within the processing region of the system body; a first head assembly disposed above one of the first platen or the second platen, and a second head assembly disposed above one of the first platen or the second platen. The first head assembly includes a first carrier head; and a first support arm coupling the first carrier head to the central rail support. The second head assembly includes a second carrier head, and a second support arm coupling the second carrier head to the central rail support. The first head assembly may further include a first rotation shaft disposed on an inner end of the first support arm opposite the first carrier head and the second head assembly further comprises a second rotation shaft disposed through an inner end of the second support arm opposite the second carrier head.

Embodiments of the disclosure may further include a system that includes a computer that is configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform one or more of the actions described herein. Other embodiments of this aspect include corresponding computer systems, apparatus, and computer programs recorded on one or more computer storage devices, each configured to perform the actions of one or more of the methods described herein.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

Where possible, identical reference numerals have been used to facilitate understanding by designating identical elements common to the figures. It is contemplated that elements and features of one embodiment may be beneficially incorporated in other embodiments without further recitation.

DETAILED DESCRIPTION

Figure 1:
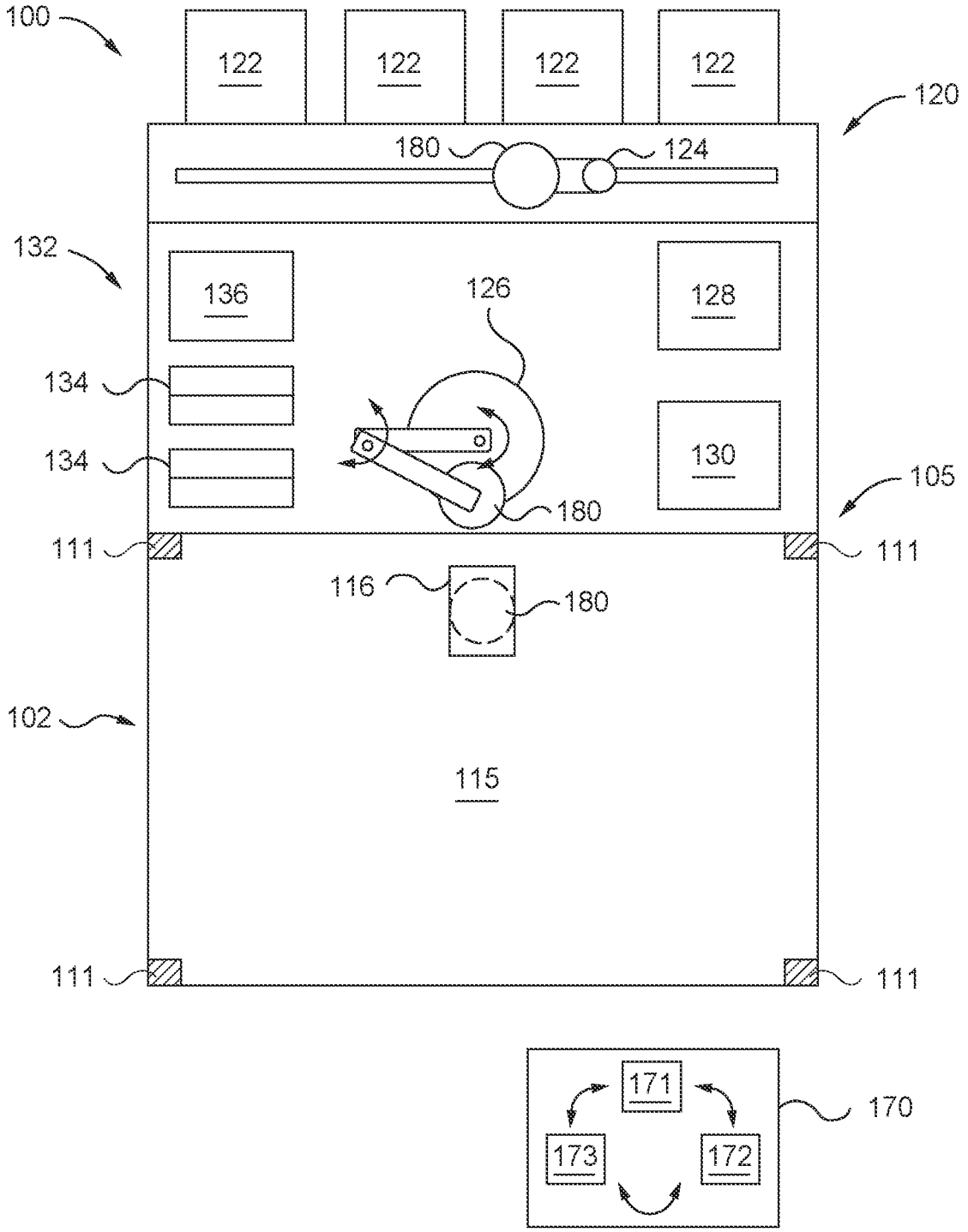
FIG. 1 is a schematic plan view of a modular polishing system comprising one or more polishing stations, according to one embodiment.

Embodiments of the present disclosure generally relate to chemical mechanical polishing (CMP) systems used in semiconductor device manufacturing. Particularly, embodiments herein are directed to modular polishing systems composed of vertically stacked polishing modules that provides for increased system throughput density and improved reliability when compared to conventional polishing systems.

In some embodiments, the CMP system throughput is increased, at least in part, by performing multiple CMP processing operations simultaneously, while maximizing the CMP system's throughput density, and preventing the complexity of the system from dramatically increasing due to the increased number of polishing pad assemblies used to process substrates. Embodiments of the disclosure provided herein utilize stationary platen and polishing pad assemblies to perform one or more polishing processes within each of the polishing modules. The stationary platen and polishing pad assemblies are held still during a polishing operation. In some operations, a first pad is utilized to polish a substrate while a second pad is cleaned or conditioned. The second pad may be disposed adjacent to the first pad, such as on an opposite side of the platen. In between process operations, the first pad and the second pad may be simultaneously indexed, such that the position of the first pad and the second pad switch.

In some embodiments described herein, the polishing station is configured for concurrent polishing and ex-situ conditioning operations where a first polishing pad is configured to polish a substrate while a second polishing pad is configured to be conditioned and cleaned in the cleaning region. Once polishing of the substrate is complete, a belt, coupled to the first and second polishing pads, is used to move the second polishing pad to the processing region for polishing a different substrate or to continue polishing of the same substrate, and meanwhile the first polishing pad is moved to the cleaning region for conditioning and cleaning. In some embodiments, the first and second polishing pads are differently configured to facilitate multi-stage processes. In one example, a substrate is urged against the first polishing pad during a first polishing stage, the belt moves the second polishing pad to the processing region, and the substrate is urged against the second polishing pad during a second polishing stage. In some embodiments, the first polishing pad and the second polishing pad are formed to have one or more different material properties or physical characteristics from one another.

Generally, polishing a substrate includes urging a material surface of the substrate against a polishing pad in the presence of a polishing fluid. The material surface is urged against the polishing pad by applying a downward force on a backside (non-active) surface of the substrate while moving the substrate relative to the polishing pad. Here, the downward force on the substrate and the relative motion between the substrate and the polishing pad are substantially provided by the movement of the substrate carrier assembly and the first actuator assembly relative to the polishing pad.

The substrate carrier assembly may include a carrier head and a pneumatic assembly fluidly coupled to the carrier head. The pneumatic assembly provides pressurized gas and/or vacuum to the carrier head for use in polishing and chucking (e.g., substrate retaining) operations. In other embodiments, the carrier assembly includes one or more electromechanical actuators configured to perform some or all of the functions described in relation to the pneumatic assembly.

The first actuator assembly is configured to support the substrate carrier assembly over an upwardly facing surface of the platen and move the substrate carrier assembly in directions parallel thereto, thus providing a relative motion between a substrate disposed in the carrier head and a stationary polishing pad positioned there beneath. In some embodiments, the first actuator assembly is disposed in the processing region between the platen assembly and the system body over an upward facing polishing pad, shown herein as the first polishing pad. The first actuator assembly is configured to move the substrate carrier assembly and the polishing fluid distribution system relative to a surface of the first polishing pad facing the processing region. The second actuator assembly is configured to move the pad conditioning assembly and the pad wash system relative to a surface of a second polishing pad facing the cleaning region.

FIG. 1 is a schematic plan view of a modular polishing system 100 including one or more polishing stations 115. The polishing station 115 may be any one of the polishing station 200 of FIGS. 2A, 2B and 2C, the polishing station 300 of FIGS. 3A, 3B and 3C, the polishing station 400 of FIGS. 4A, 4B and 4C, the polishing station 600 of FIGS. 5 and 6, the polishing station 700 of FIGS. 5 and 7, or the polishing station 800 of FIGS. 8A and 8B.

Here, the modular polishing system 100 features a first portion 120 and a second portion 105 coupled to the first portion 120. The second portion 105 includes one or more polishing stations 115 which include one or more polishing modules. The one or more polishing stations 115 include structural supports 111 for holding and supporting the polishing modules within the one or more polishing stations 115. Each of the one or more polishing stations 115 includes at least a transfer station 116 for placement of the one or more substrates 180 into the one or more polishing stations 115. As described in FIGS. 2A-8B, each of the one or more polishing stations 115 further includes one or more platens that are adapted to receive one or more polishing pads thereon. A polishing head is also disposed within each of the polishing stations 115 for polishing of a substrate.

Figure 2A:
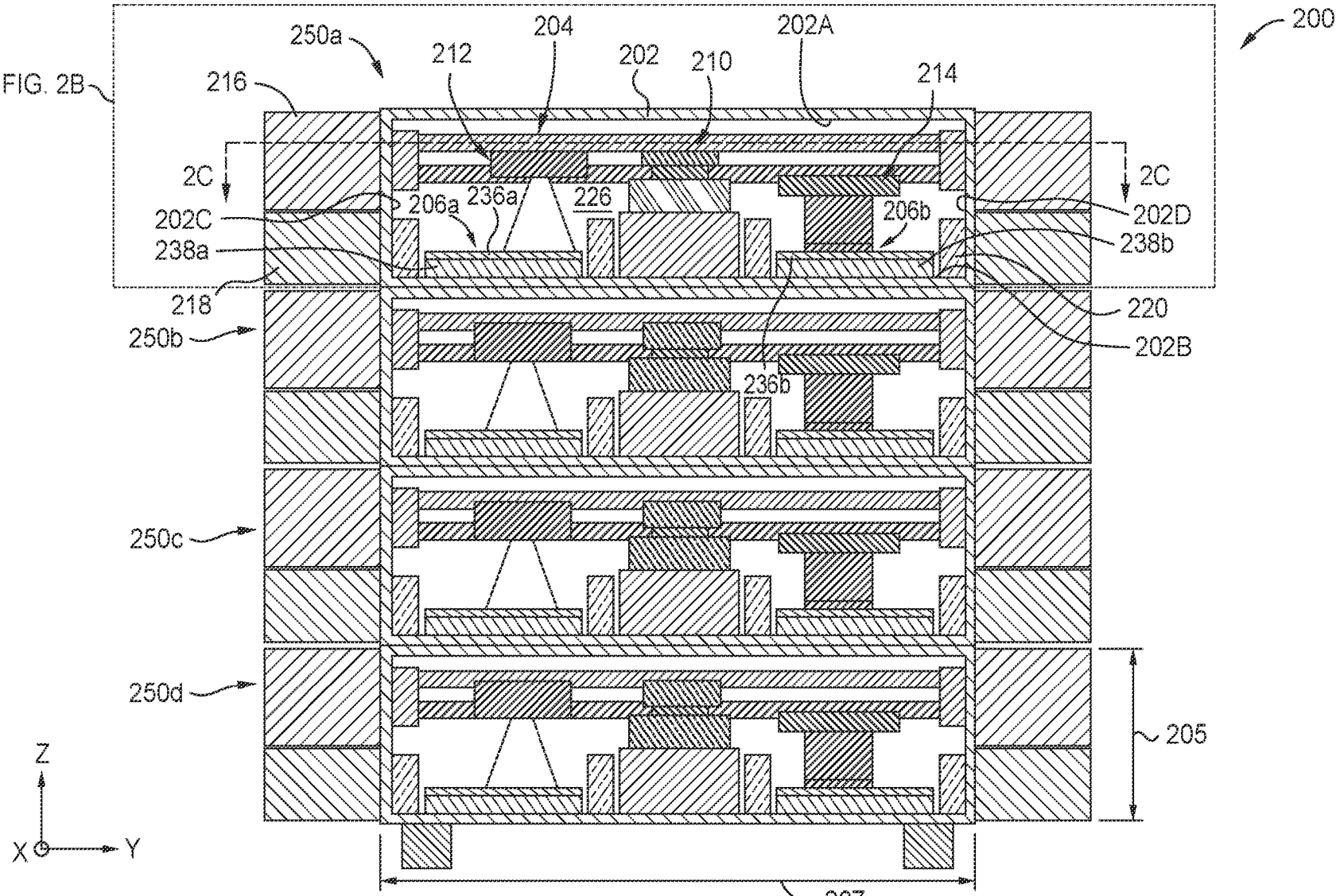
FIG. 2A is a schematic side cross-sectional view of a polishing station, according to one embodiment.
Figure 2B:
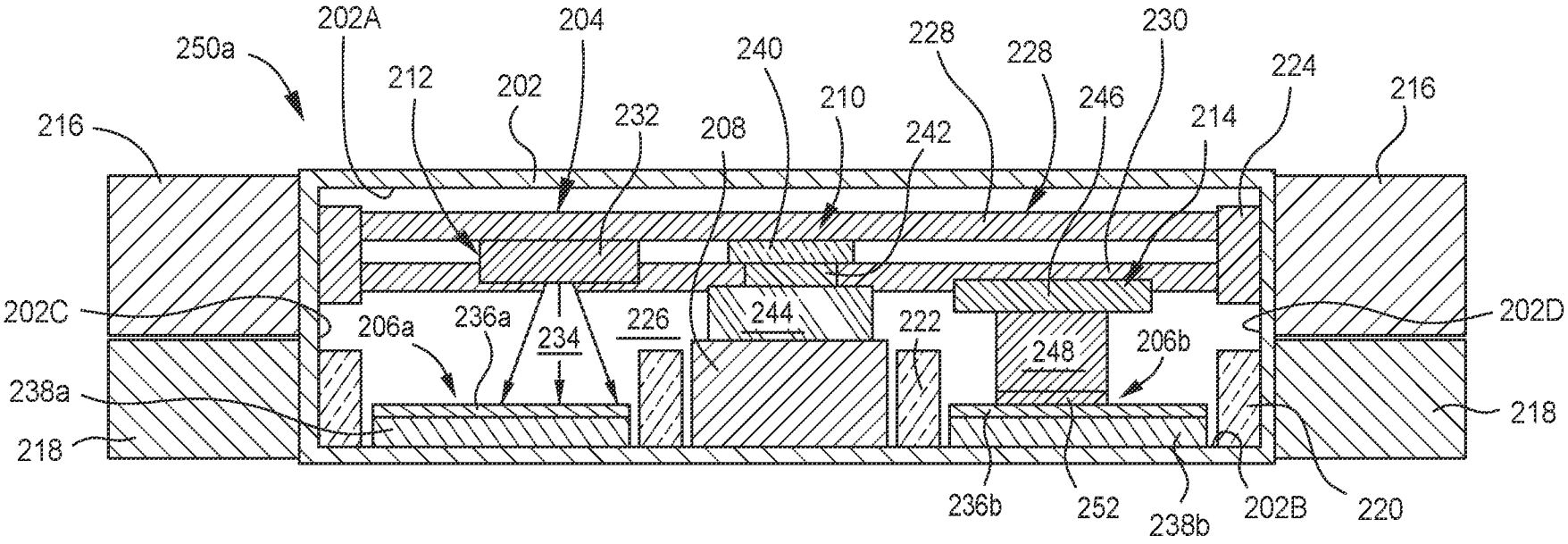
FIG. 2B is a close-up side cross-sectional view of a polishing station illustrated in FIG. 2A, according to one embodiment.
Figure 2C:
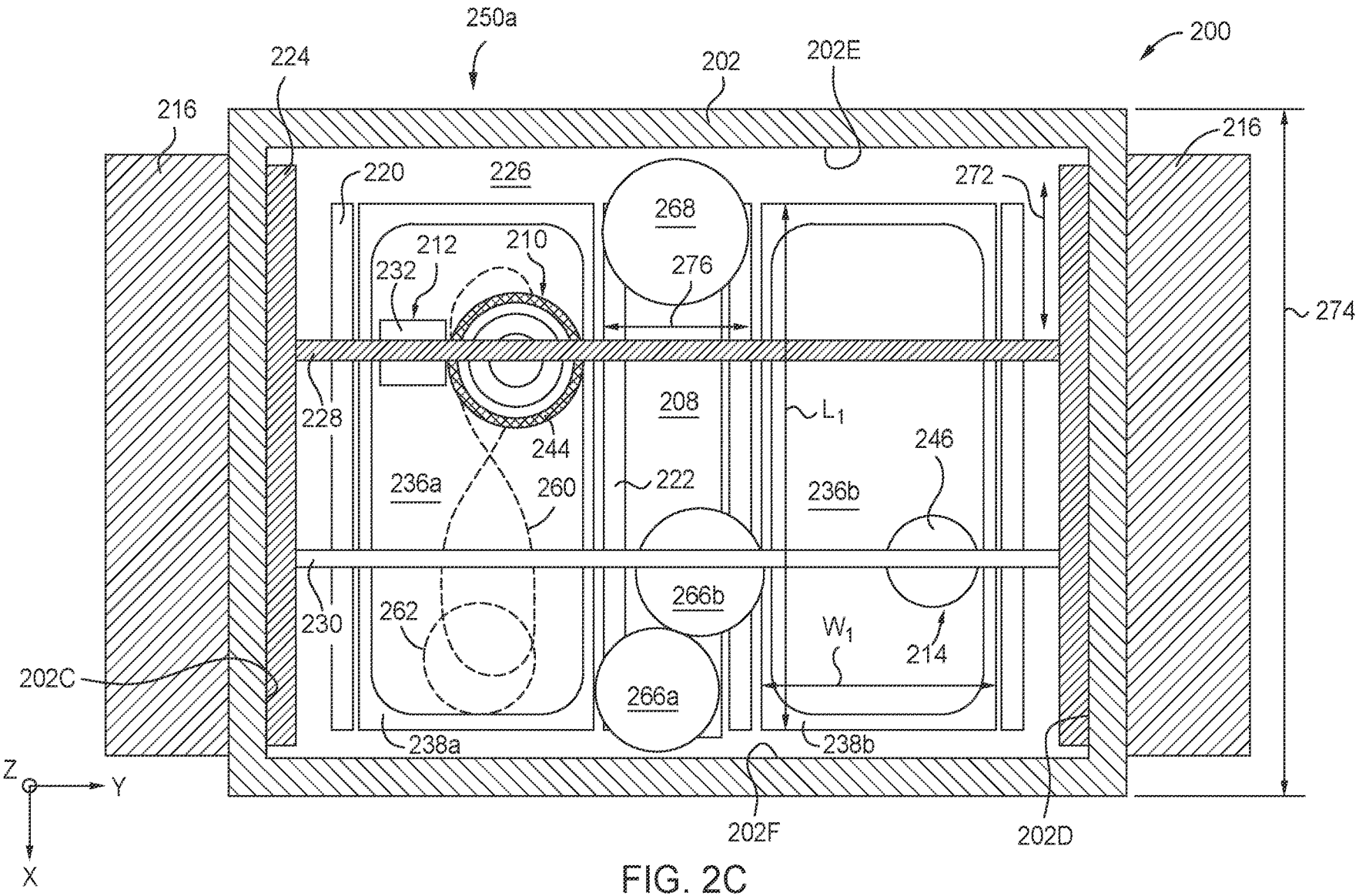
FIG. 2C is a schematic top partial cross-sectional view of the polishing station of FIG. 2B, according to one embodiment.

FIG. 2A is a schematic side view of a polishing station 200. The polishing station 200 includes a plurality of polishing modules 250*a*, 250*b*, 250*c*, 250*d*. FIG. 2B is close-up side view of a polishing module of the polishing station 200. FIG. 2C is a schematic top partial cross-sectional view of the polishing station illustrated in FIG. 2B. In some embodiments, there is a first polishing module 250*a*, a second polishing module 250*b*, a third polishing module 250*c*, and a fourth polishing module 250*d*. Each of the first polishing module 250*a*, the second polishing module 250*b*, the third polishing module 250*c*, and the fourth polishing module 250*d* are similar and include similar components for processing a substrate. The plurality of polishing modules 250*a*, 250*b*, 250*c*, 250*d* are stackable in a vertical direction, such that the footprint of the polishing station 200 is significantly smaller than conventional CMP tools that include two or more polishing modules or polishing areas that are laid-out in a single plane. The polishing station 200 will also include an improved substrate throughput density.

Typically, the first portion 120 comprises one or combination of a plurality of system loading stations 122, one or more substrate handlers, e.g., a first robot 124 and a second robot 126, one or more metrology stations 128, one or more location specific polishing (LSP) modules 130, and one or more one or more post-CMP cleaning systems 132. An LSP module 130 is typically configured to polish only a portion of a substrate surface using a polishing member (not shown) that has a surface area that is less than the surface area of a to-be-polished substrate. LSP modules 130 are often used after a substrate has been polished within a polishing module to touch up, e.g., remove additional material, from a relatively small portion of the substrate. In some embodiments one or more LSP modules 130 may be included within the second portion 105 in place of one of the polishing modules or coupled to one of the polishing modules.

In other embodiments the one or more LSP modules 130 may be disposed in any other desired arrangement within the modular polishing systems set forth herein. For example, one or more LSP modules 130 may be disposed between the first portion 120 and the second portion 105, between adjacently disposed polishing modules in any of the arrangements described herein, and/or proximate to an end of any of the second portions described herein, the end of the respective second portion being distal from the first portion. In some embodiments, the modular polishing systems may include one or more buffing modules (not shown) which may be disposed in any of the arrangements described above for the LSP module 130. In some embodiments, the first portion 120 features at least two post-CMP cleaning systems 132 which may be disposed on opposite sides of the second robot 126.

The post-CMP cleaning system 132 facilitates removal of residual polishing fluids and polishing byproducts from the substrate 180 and may include any one or combination of brush or spray boxes 134 and a drying unit 136. The first and second robots 124, 126 are used in combination to transfer substrates 180 between the second portion 105 and the first portion 120 including between the various modules, stations, and systems thereof. For example, here, the second robot 126 is at least used to transfer substrates to and from the transfer station 116, the one or more metrology stations, the LSP modules 130, the brush or spray boxes 134, and the drying unit 136.

In embodiments herein, operation of the modular polishing system 100 is directed by a system controller 170. The system controller 170 includes a programmable central processing unit (CPU) 171 which is operable with a memory 172 (e.g., non-volatile memory) and support circuits 173. The support circuits 173 are conventionally coupled to the CPU 171 and comprise cache, clock circuits, input/output subsystems, power supplies, and the like, and combinations thereof coupled to the various components of the modular polishing system 100, to facilitate control thereof. The CPU 171 is one of any form of general purpose computer processor used in an industrial setting, such as a programmable logic controller (PLC), for controlling various components and sub-processors of the processing system. The memory 172, coupled to the CPU 171, is non-transitory and is typically one or more of readily available memories such as random access memory (RAM), read only memory (ROM), floppy disk drive, hard disk, or any other form of digital storage, local or remote.

Typically, the memory 172 is in the form of a non-transitory computer-readable storage media containing instructions (e.g., non-volatile memory), which when executed by the CPU 171, facilitates the operation of the modular polishing system 100. The instructions in the memory 172 are in the form of a program product such as a program that implements the methods of the present disclosure. The program code may conform to any one of a number of different programming languages. In one example, the disclosure may be implemented as a program product stored on computer-readable storage media for use with a computer system. The program(s) of the program product define functions of the embodiments (including the methods described herein).

Illustrative non-transitory computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory devices, e.g., solid state drives (SSD) on which information may be permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure. In some embodiments, the methods set forth herein, or portions thereof, are performed by one or more application specific integrated circuits (ASICs), field-programmable gate arrays (FPGAs), or other types of hardware implementations. In some other embodiments, the substrate processing and/or handling methods set forth herein are performed by a combination of software routines, ASIC(s), FPGAs and, or, other types of hardware implementations. One or more system controllers 170 may be used with one or any combination of the various modular polishing systems described herein and/or with the individual polishing modules thereof.

Polishing Modules

Each of the polishing modules 250*a*, 250*b*, 250*c*, 250*d* includes a system body 202, a first platen 238*a* disposed within the system body 202, a second platen 238*b* disposed within the system body 202, a carrier head assembly 210, an x-y gantry assembly 204 disposed over the first platen 238*a* and the second platen 238*b* within the system body 202, a liquid delivery unit 212, and one or more pad conditioners 214. The enclosed region within the system body 202 includes the process volume 226, which is defined by a plurality of inner walls 202A-202F of the system body 202. The inner walls 202A-202F include an upper inner sidewall 202A, a bottom inner sidewall 202B opposite the upper inner sidewall 202A, a first inner sidewall 202C disposed between the upper inner sidewall 202A and the bottom inner sidewall 202B, a second inner sidewall 202D opposite the first inner sidewall 202C, a third inner sidewall 202E, and a fourth inner sidewall 202F. The upper inner sidewall 202A may also be referred to as a ceiling of the system body 202. Each of the first platen 238*a*, the second platen 238*b*, the carrier head assembly 210, the x-y gantry assembly 204, the liquid delivery unit 212, and the one or more pad conditioners 214 are disposed within the process volume 226.

The liquid delivery unit 212 may be a slurry delivery module and is configured to supply a slurry and/or one or more processing fluids (e.g., one or more liquids 234 of FIG. 2B) to a top surface of pads 236*a*, 236*b* that are disposed on the platens 238*a*, 238*b*. In some embodiments, the pads 236*a*, 236*b* are polishing pads, such as substrate polishing pads or semiconductor substrate polishing pads. In the embodiment of FIGS. 2A-2C, each of the liquid delivery unit 212, the carrier head assembly 210, and the pad conditioner 214 are coupled to the x-y gantry assembly 204, such that the x-y gantry assembly 204 is configured to enable movement of each of the carrier head assembly 210, the pad conditioner 214, and the liquid delivery unit 212 in both an x-direction and a y-direction. In some embodiments, the movement of the carrier head assembly 210, the pad conditioner 214, or the liquid delivery unit 212 in both an x-direction and a y-direction are created by use of one or more actuators (e.g., pneumatic or electromechanical actuators) that are configured to provide the desired motion of these components. Therefore, the various actuators within the x-y gantry assembly 204 and components within the system controller 170 enable movement of the liquid delivery unit 212, the carrier head assembly 210, and the pad conditioner 214 relative to each of the first platen 238*a*, the second platen 238*b*, and the first and second pads 236*a*, 236*b* disposed thereon.

As illustrated in FIG. 2B the x-y gantry assembly 204 is configured to actuate each of the carrier head assembly 210, the pad conditioner 214, and the liquid delivery unit 212 in an x-direction and a y-direction. The x-y gantry assembly 204 includes one or more cross-beams 228, 230 as well as a plurality of runway beams 224. In some embodiments, the cross-beams 228, 230 are referred to as bridge girders or bridge rails, such that the cross beams 228, 230 form a bridge between two runway beams 224. The cross-beams 228, 230 are disposed on top of or inserted into the runway beams 224, such that the cross-beams 228, 230 are supported by the runway beams 224. In embodiments described herein, there are two cross beams 228, 230, such as a first cross beam 228 and a second cross beam 230.

The first cross beam 228 is coupled to, configured to support, and actuates one or both of the liquid deliver unit 212 and the carrier head assembly 210. The second cross beam 228 is coupled to, configured to support, and actuates the pad conditioner 214. In some embodiments, the first cross beam 228 supports the carrier head assembly 210, the pad conditioner 214, and the liquid delivery unit 212. In other embodiments, each of the carrier head assembly 210, the pad conditioner 214, and the liquid delivery unit 212 are disposed on separate cross beams 228, 230 or sets of cross beams 228, 230, such that there are three cross beams 228, 230. In embodiments wherein each of the carrier head assembly 210, the pad conditioner 214, and the liquid delivery unit 212 are disposed on separate cross beams 228, 230, there may be three or more cross beams 228, 230. Each of the cross beams 228, 230 may represent a set of adjacent cross beams 228, 230 which are parallel and configured to hold a trolley which actuates along the cross beams 228, 230. At least one end of the cross beams 228, 230 may have a driver and/or actuator coupled thereto. As shown in FIGS. 2A-2B, the driver or actuator is configured to move the cross beams 228, 230 along the runway beams 224 in a first direction (e.g., +x-direction and −x-direction).

The carrier head assembly 210 is coupled to one of the cross beams 228, 230 of the x-y gantry assembly 204. The carrier head assembly 210 includes a carrier head trolley frame 240 coupling a carrier head 244 to the x-y gantry assembly 204. As illustrated in FIGS. 2A-2B, the carrier head 244 is positioned in the x-y plane over a carrier loading station 268 (FIG. 2C). In FIG. 2C, the carrier head 244 is positioned in the x-y plane over the polishing pad 236*a*. The carrier head assembly 210 is often referred to herein as a polishing head assembly, while the carrier head 244 is often referred to herein as a polishing head. The carrier head trolley frame 240 is configured to support the carrier head 244 and actuate the carrier head 244 along the cross beam 228 in a second direction (e.g., +y-direction and −y-direction). A vertical actuator 242 is disposed between the carrier head 244 and the carrier head trolley frame 240, such that the vertical actuator 242 is configured to move the carrier head 244 in a third direction (e.g., +z-direction and −z-direction) relative to the carrier head trolley frame 240 and the x-y gantry assembly 204.

The vertical actuator 242 may be a hydraulic actuator and may be coupled to one or more pneumatic assemblies, such as an electrical or pneumatic component 216. A slide or rail within the vertical actuator 242 is used to slideably couple the carrier head 244 to the trolley frame 240. The carrier head 244 is configured to hold one or more substrates during a polishing process. The carrier head 244 may lift a substrate off of a supporting surface within the system body 202, such as one of the pads 236*a*, 236*b*. The carrier head 244 is also configured to apply backside pressure on the substrate to urge the substrate against the pads 236*a*, 236*b*. As briefly discussed above, the carrier head 244 includes a retaining ring that surrounds the substrate during polishing and one or more of flexible components, such as bladders, diaphragms, or membrane layers (not shown) which may, along with other components of the carrier head 244, define chambers disposed therein. The flexible components of the carrier head 244 and the chambers defined therewith are useful for both substrate polishing and substrate loading and unloading operations. Negative and positive pressures are provided to the chambers by use of a gas provided from the pneumatic assembly to allow the substrate loading and polishing operations, respectively. For example, a chamber defined by the one or more flexible components may be pressurized to urge a substrate disposed in the carrier head towards the polishing pad by pressing components of the carrier head against the backside of the substrate. When polishing is complete, or during substrate loading operations, a substrate may be vacuum chucked to the carrier head 244 by applying a vacuum to the same or a different chamber to cause an upward deflection of a membrane layer in contact with the backside of the substrate. The upward deflection of the membrane layer will create a low pressure pocket between the membrane and the substrate, thus vacuum chucking the substrate to the carrier head 244. During substrate unloading operations, where the substrate is unloaded from the carrier head 244 into a carrier loading station 268 (FIG. 2C), a pressurized gas may be introduced into the chamber. The pressurized gas in the chamber causes a downward deflection of the membrane to release a substrate from the carrier head 244 into the carrier loading station 268. In some embodiments, the carrier head 244 is described as a carrier head. Material is removed from the pad facing surface of the substrate through a combination of chemical and mechanical activity provided by a polishing fluid, the downward force on the substrate, and the relative motion between the substrate and the polishing pad.

The liquid deliver unit 212 is coupled to one of the cross beams 228, 230 of the x-y gantry assembly 204. The liquid deliver unit 212 includes a liquid delivery trolley frame coupling a liquid delivery member 232 to the x-y gantry assembly 204. The liquid delivery trolley frame is configured to support the liquid delivery member 232 and cause the liquid delivery member 232 to be moved and positioned along portions of the cross beam 228 that are disposed at points along the +x-direction and −x-direction. The liquid deliver unit 212 supplies one or more liquids 234 or fluids to be dispensed onto one of the pads 236*a*, 236*b*. The liquid delivery unit 212 may be coupled to one or more fluid sources, such as the liquid delivery modules 218. The liquid delivery member 232 is configured to supply one or both of a polishing fluid, a cleaning fluid and/or a water. The liquid 234 provided from the liquid delivery unit 212 provides fluids at a desired flow rate and pressure. The polishing fluid source may provide one or more fluids that include a chemical solution (e.g., acid, base, inhibitor, etc.) and/or slurry containing solution (e.g., abrasive particle (e.g., silica, ceria, or alumina based abrasives) containing solution used for substrate polishing. The water which may be utilized within the liquid delivery unit 212 is a de-ionized water source. The liquid delivery unit 212 may include a pump or a plurality of pumps (one for each fluid) that are used to deliver a fluid at a desired flow rate and pressure to the one of the pads 236*a*, 236*b*.

The liquid 234 provided by the liquid delivery unit 212 is dispensed onto one of the first pad 236*a* or the second pad 236*b*. The liquid 234 is delivered to the first pad 236*a* or the second pad 236*b* as a spray, such that the spray is emitted by a nozzle of the liquid delivery member 232 onto the first pad 236*a* or the second pad 236*b*. The spray is a continuous stream of liquid, such as a chemical solution, slurry containing solution, or water.

The pad conditioner 214 is coupled to one of the cross beams 228, 230 of the x-y gantry assembly 204. In the embodiment of FIG. 2A, the pad conditioner 214 is coupled to the cross beam 230 that is positioned below the cross beam 228. The pad conditioner 214 includes a conditioner trolley frame 246 coupling a conditioning disk 252 to the x-y gantry assembly 204. The conditioner trolley frame 246 is configured to support the conditioning disk 252 and actuate the conditioning disk 252 so that it is translated along the cross beam 230 in the +y-direction and −y-direction. A vertical actuator 248 is disposed between the conditioning disk 252 and the conditioner trolley frame 246, such that the vertical actuator 248 is configured to move the conditioning disk 252 in a +z-direction and −z-direction relative to the conditioner trolley frame 246 and the x-y gantry assembly 204. The vertical actuator 248 may be a hydraulic actuator and may be coupled to one or more motion assemblies, which include an electrical or pneumatic component 216. A slide or rail within the vertical actuator 248 is used to slideably couple the conditioning disk 252 to the conditioner trolley frame 246. The conditioning disk 252 is used to abrade and/or rejuvenate the pads 236*a*, 236*b* by removing a portion of the polishing pad surface during a pad conditioning process, by urging an abrasive pad conditioning disk (e.g., a diamond impregnated disk) thereagainst. Pad conditioning operations may be done between polishing substrates, i.e., ex-situ conditioning, concurrently with polishing a substrate, i.e., in-situ conditioning, or both. In some embodiments, the conditioning disk 252 includes a mounting plate for mounding a conditioner disk thereto.

In some embodiments, as illustrated in FIGS. 2A-2C, neither the carrier head 244 nor the conditioning disk 252 are configured to rotate around a central axis that extends through the center of the retaining ring, the flexible elements, and the substrate retained in the carrier head 244 or the pad conditioning disk 252, respectively. Instead, the x-y gantry assembly 204 is configured to move each of the carrier head 244 and the conditioning disk 252 in a desired pattern along the top surfaces of the first pad 236*a* and the second pad 236*b*. In this configuration, the carrier head 244 portion and platen 238 of a polishing module 250 is greatly simplified and much less costly versus conventional CMP polishing hardware designs that require the polishing pad, conditioning disk and portions of the carrier head to be simultaneously separately rotated and translated relative to each other. One skilled in the art will appreciate that the hardware configurations disclosed herein that are used to perform a polishing process, which are discussed further below, will provide a significant decrease in manufacturing cost, maintenance cost, and an increase in reliability due to the removal of, or a lack of a need for, actuators and coupling assemblies that are able to enable rotation and/or translation of these components, while maintaining their alignment with the pad surface during processing. The liquid delivery unit 212 is configured to lead or follow the carrier head 244 to deliver liquid to the first pad 236*a* and the second pad 236*b* during a polishing operation.

As illustrated in FIGS. 2A-2C, the first platen 238*a* is disposed on a first side of the polishing volume 226 within the system body 202. A basin (not shown) may be disposed around the first platen 238*a* to catch any slurry, water, or other fluids which fall off of a pad disposed on the first platen 238*a*. The first platen 238*a* is formed of a metal material and may include multiple sub-layers for supporting a pad, such as the first pad 236*a*. As noted above, the first platen 238*a* is a stationary platen and is not configured to be rotated or be translated, and thus significantly simplifying this area of a polishing module 250 over conventional CMP hardware designs. The second platen 238*b* is disposed on a second side of the polishing volume 226 within the system body 202. A basin (not shown) may be disposed around the second platen 238*b* to catch the slurry, water, or other fluids which fall off of a pad disposed on the second platen 238*b*. The second platen 238*b* is similar to the first platen 238*a*, but is configured to support the second pad 236*b*, and, in some embodiments, simultaneously process a second substrate thereon.

Each of the first platen 238*a* and the second platen 238*b* are flanked by auxiliary supports 220, 222. The auxiliary supports include a first auxiliary support 220 and a second auxiliary support 222. In some embodiments, the auxiliary supports 220, 222 are each configured to support one or more additional arms or devices. In some embodiments, the auxiliary supports 220, 222 are configured to support one or more slurry arms, one or more conditioner arms, or one or more sensors (e.g., cameras, pH sensors, etc.). Each of the auxiliary supports 220, 222 include one or more rails and actuators that are disposed at a position along the length of the platens 238*a*, 238*b* in the +/−x-directions.

The electrical and pneumatic component assemblies 216 are positioned at and/or coupled to an outer sidewall of the system body 202. In some embodiments, each of the polishing modules 250*a*, 250*b*, 250*c*, 250*d* include electrical and pneumatic components that are each disposed in different areas of the electrical and pneumatic component assemblies 216. In some embodiments, each of the polishing modules 250*a*, 250*b*, 250*c*, 250*d* share an electrical and pneumatic component assembly 216. Although shown attached to the sides of the polishing modules 250*a*, 250*b*, 250*c*, 250*d*, the electrical and pneumatic component assemblies 216 may also be coupled to a top or a bottom of one of the polishing modules 250*a*, 250*b*, 250*c*, 250*d*.

The electrical and pneumatic component assemblies 216 include components that enable the actuation and/or delivery of fluids during portions of a polishing process performed in the various polishing modules 250*a*, 250*b*, 250*c*, 250*d*. In some embodiments, the electrical and pneumatic component assemblies 216 include one or more sub-controllers, one or more power sources, a pneumatic pressure reservoir, a vacuum pump, an air pump, pneumatic valves, pressure regulators, shutoff valves, or one or more gas sources. Each of the components within the system body 202 may be coupled to a sub-controller disposed within the electrical and pneumatic component assemblies 216 to allow the distribution and control of the power and/or pressure applied thereto.

The liquid delivery modules 218 are similarly positioned at and/or coupled to an outer sidewall of the system body 202. In some embodiments, each of the polishing modules 250*a*, 250*b*, 250*c*, 250*d* each include separate liquid delivery modules 218. In other embodiments, each of the polishing modules 250*a*, 250*b*, 250*c*, 250*d* share one or two liquid delivery modules 218. Although shown attached to the sides of the polishing modules 250*a*, 250*b*, 250*c*, 250*d*, the liquid delivery modules 218 may also be coupled to a top or a bottom of one of the polishing modules 250*a*, 250*b*, 250*c*,

250*d*. The liquid delivery modules 218 are configured to supply and control the delivery of one or more liquids to the components within the process volume 226. The liquid delivery modules 218 are therefore configured to delivery one or a combination of a chemical solution (e.g., acid, base, inhibitor, etc.), a slurry containing solution (e.g., abrasive particle (e.g., silica, ceria, or alumina based abrasives) containing solution) used for substrate polishing, or water (e.g., deionized water).

In addition to the discussion provided above, each of the polishing modules 250*a*, 250*b*, 250*c*, 250*d* include a central support 208 extending from a bottom surface 202C of the system body 202. The central support 208 is configured to support one or all of a first head wash 266, a second head wash 266*b*, and the carrier loading station 268 (FIG. 2C). The central support 208 is disposed between the first platen 238*a* and the second platen 238*b*.

The carrier loading station 268 is positioned at a distal end of the central support 208 and adjacent to an end sidewall 202E of the system body 202. The carrier loading station 268 is configured to receive and hold a substrate, when a substrate is moved into the process volume 226 of the system body 202 and placed into the carrier loading station 268 by the second robot 126. In some embodiments, the carrier loading station 268 is referred to as a load cup. The substrate is then transferred onto one or more of the first pad 236*a* or the second pad 236*b* on the platens 238*a*, 238*b* from the carrier loading station 268 by use of one or more robots (not shown) or by use of a carrier head assembly 210.

The first head wash 266*a* and the second head wash 266*b* are coupled to an opposite end of the central support 208 from the carrier loading station 268. In some embodiment of each module, there is only one head wash station. The first head wash 266*a* and the second head wash 266*b* are configured to enable the carrier head assembly 210 and the pad conditioner 214 to be washed between polishing processes performed on the substrates. In some embodiments, the location of the carrier loading station 268 and the head washes 266*a*, 266*b* are switched.

During a polishing process, the carrier head assembly 210 is actuated in a pre-determined pattern 260 so as to cause a substrate disposed within the carrier head assembly 210 to follow a path that is created by the actuation pattern. The pre-determined pattern 260 may form a leminiscate path, such as a path that is a figure-eight shape. The pre-determined pattern 260 may also form a zig-zag or an ovoid shape path. Other shapes for the pre-determined pattern 260 are also contemplated. The pre-determined pattern 260 is configured to assure uniform removal of material across a surface of the substrate. To form the pre-determined pattern 260, the carrier head assembly 210, pad conditioner 214, and liquid delivery unit 212 are moved in at least a first direction 276 along each of the cross beams 228, 230. Each of the cross beams 228, 230 may also be simultaneously moved in a second direction 272 along the runway beams 224. The pre-determined pattern 260 illustrated is a path formed by a central axis of a substrate as the substrate is actuated over the pads 236*a*, 236*b*. In some embodiments, the substrate is placed on one of the pads 236*a*, 236*b* using a robot different from the carrier head assembly 210. The substrate may be placed at a placement position 262 along the pre-determined pattern 260. One of the carrier head assemblies 210 may then be actuated to the placement position 262 to secure the substrate under the carrier head assembly 210. The placement position 262 may be anywhere on the pads 236*a*, 236*b*. In some embodiments, the substrate is placed at a placement position 262 and then one or both of the pads 236*a*, 236*b* are actuated relative to the platen 238 and sidewalls 202C, 202D, 202E, 202F to move the substrate beneath one of the carrier head assemblies 210.

The platens 238*a*, 238*b* have a rectangular shape in the plan view, such that the top surface of each of the platens 238*a*, 238*b* on which a pad is disposed is rectangular. In some embodiments, the corners of the rectangle may be chamfered or rounded. In some embodiments, the top surfaces of the platens 238*a*, 238*b* are ovoid in shape. In some embodiments, each of the platens 238*a*, 238*b* has a first length $L_1$ and a first width $W_1$. The first length $L_1$ is the length of one of the platens 238*a*, 238*b* in the x-direction. The first width $W_1$ is the width of one of the platens 238*a*, 238*b* in the y-direction. In some embodiments, the first length $L_1$ is greater than the first width $W_1$, such as about 1.5 times greater, such as about 2 times greater, such as about 2.5 times greater, such as about 3 times greater. Therefore, the aspect ratio of the first length $L_1$ to the first width $W_1$ of either of the platens 238*a*, 238*b* is greater than about 1.5:1, such as greater than about 2:1, such as greater than about 2.5:1, such as greater than about 3:1. The increased first length $L_1$ relative to the first width $W_1$ improves the ability to create a variety of polishing patterns, such as the leminiscate pattern.

In one embodiment, during a polishing process, the carrier head assembly 210 is actuated in a pre-determined pattern 260 over a first portion of a pad 236*a*, while the pad conditioning disk 252 of the conditioner trolley frame 246 is configured to perform a pad conditioning process on a second portion of the pad 236*a*. After a substrate is finished being polished within the first portion of the pad 236*a*, the conditioned second portion of the pad 236*a* is then indexed to a position where the first portion of the pad 236*a* was positioned so that another polishing process can be performed on the second portion of the pad 236*a* by use of the carrier head assembly 210 positioned thereover. In one example, the first portion and second portion are equal portion of the pad 236*a*, such as each portion being about 50% of the surface area of the pad 236*a*. In one embodiment, the first portion and second portion are positioned serially in the first length $L_1$ of a pad direction (i.e., X-direction). Alternately, in cases where the pad can be indexed or repositioned in a lateral direction (i.e., Y-direction), in another embodiment, the first portion and second portion are positioned serially in the first width $W_1$ direction.

Each of the polishing modules 250*a*, 250*b*, 250*c*, 250*d* has a module height 205, a module width 207, and a module length 274. The module height 205 is the height of one of the polishing modules 250*a*, 250*b*, 250*c*, 250*d* in the z-direction normal to the x-direction and the y-direction. The module width 207 is the width of one of the polishing modules 250*a*, 250*b* 250*c*, 250*d* in a y-direction normal to the x-direction and the z-direction. The module length 274 is the length of one of the polishing modules 250*a*, 250*b*, 250*c*, 250*d*. The module height 205 is less than about 2000 mm, such las less than about 1500 mm, such as less than about 1250 mm, such as less than about 1000 mm, such as less than about 750 mm, such as less than about 600 mm. The module width 207 is less than about 2500 mm, such as less than about 2250 mm, such as less than about 2000 mm, such as less than about 1800 mm. The module length 274 is about 1000 mm to about 2500 mm, such as about 1000 mm to about 2000 mm, such as about 1000 mm to about 1500 mm, such as about 1000 mm to about 1250 mm.

The dimensions of each of the polishing modules 250*a*, 250*b*, 250*c*, 250*d* enable each of the polishing modules 250*a*, 250*b*, 250*c*, 250*d* to be smaller than a traditional chemical mechanical polishing assembly. The module height 205, module width 207, and module length 274 further enable stacking of the polishing modules 250*a*, 250*b*, 250*c*, 250*d*. By not rotating the carrier head assembly 210 or the platens 238*a*. 238*b*, the amount of rotary devices within the polishing modules 250*a*, 250*b*, 250*c*, 250*d* is decreased. As rotary devices are often bulky, the removal of rotary devices enables smaller polishing module 250*a*, 250*b*, 250*c*, 250*d* dimensions.

Figure 3A:
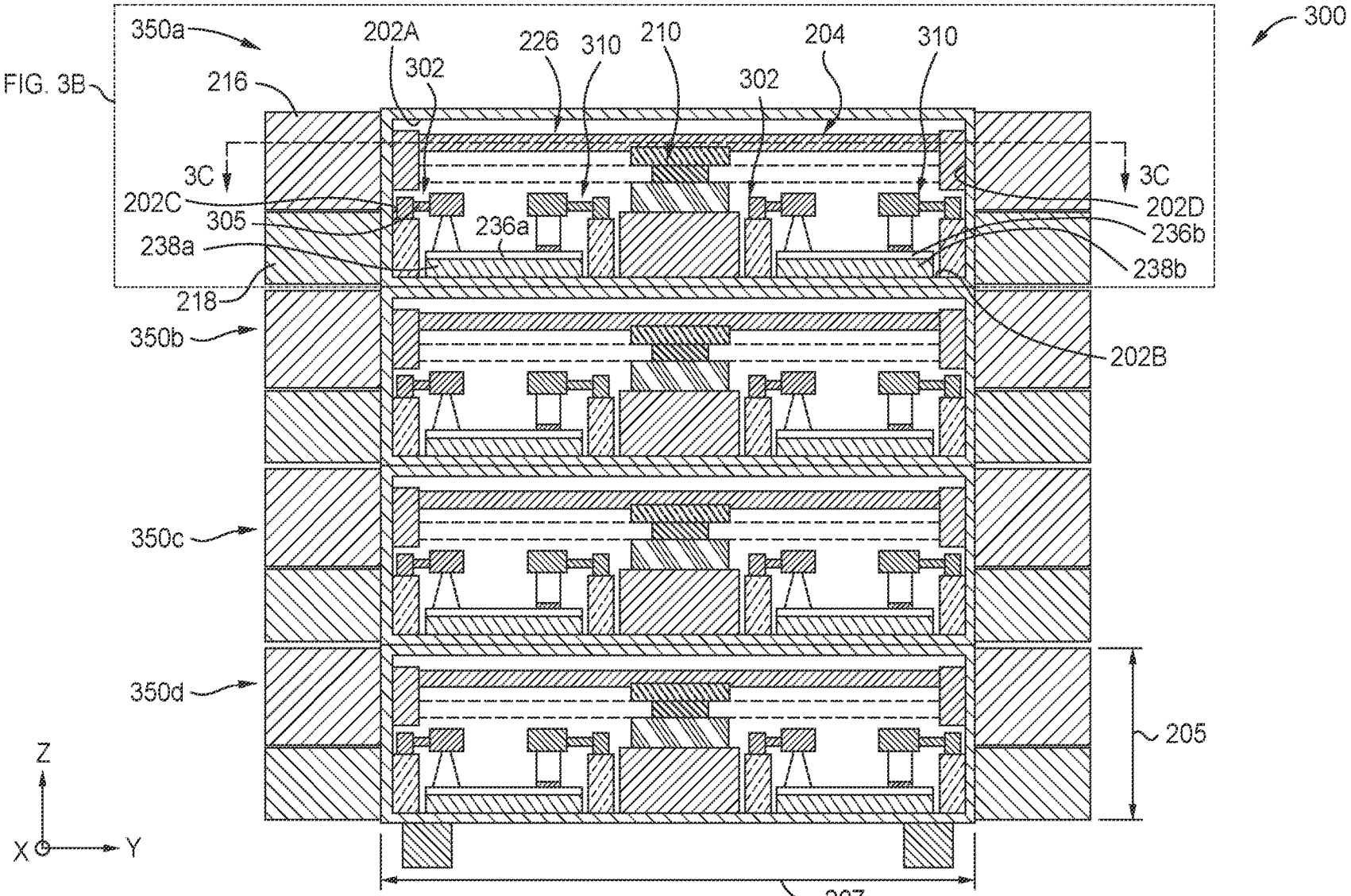
FIG. 3A is a schematic side cross-sectional view of another polishing station, according to one embodiment.

FIG. 3A is a schematic side cross-sectional view of another polishing station 300. The polishing station 300 includes a plurality of polishing modules 350*a*, 350*b*, 350*c*, 350*d*. In some embodiments of a polishing station, there is a first polishing module 350*a*, a second polishing module 350*b*, a third polishing module 350*c*, and a fourth polishing module 350*d*. Each of the first polishing module 350*a*, the second polishing module 350*b*, the third polishing module 350*c*, and the fourth polishing module 350*d* are similar and include similar components for processing a substrate. The plurality of polishing modules 350*a*, 350*b*, 350*c*, 350*d* are vertically stackable, such that the footprint of the polishing station 300 is smaller and has an improved substrate throughput density.

Each of the polishing modules 350*a*, 350*b*, 350*c*, 350*d* are similar to the polishing modules 250*a*, 250*b*, 250*c*, 250*d* of FIGS. 2A-2C, but the liquid delivery unit 212 is replaced by a plurality of liquid delivery arms 302 and the one or more pad conditioners 214 are replaced with a plurality of pad conditioner arms 310. The second cross-beam may also be optional and may have a second carrier head assembly 360 (FIG. 3C) coupled thereto so as to allow the simultaneous processing of substrates in one or more pads in each of the polishing modules. The second carrier head assembly 360 is similar to the first carrier head assembly 210 and may be referred to as a polishing head assembly.

Figure 3B:
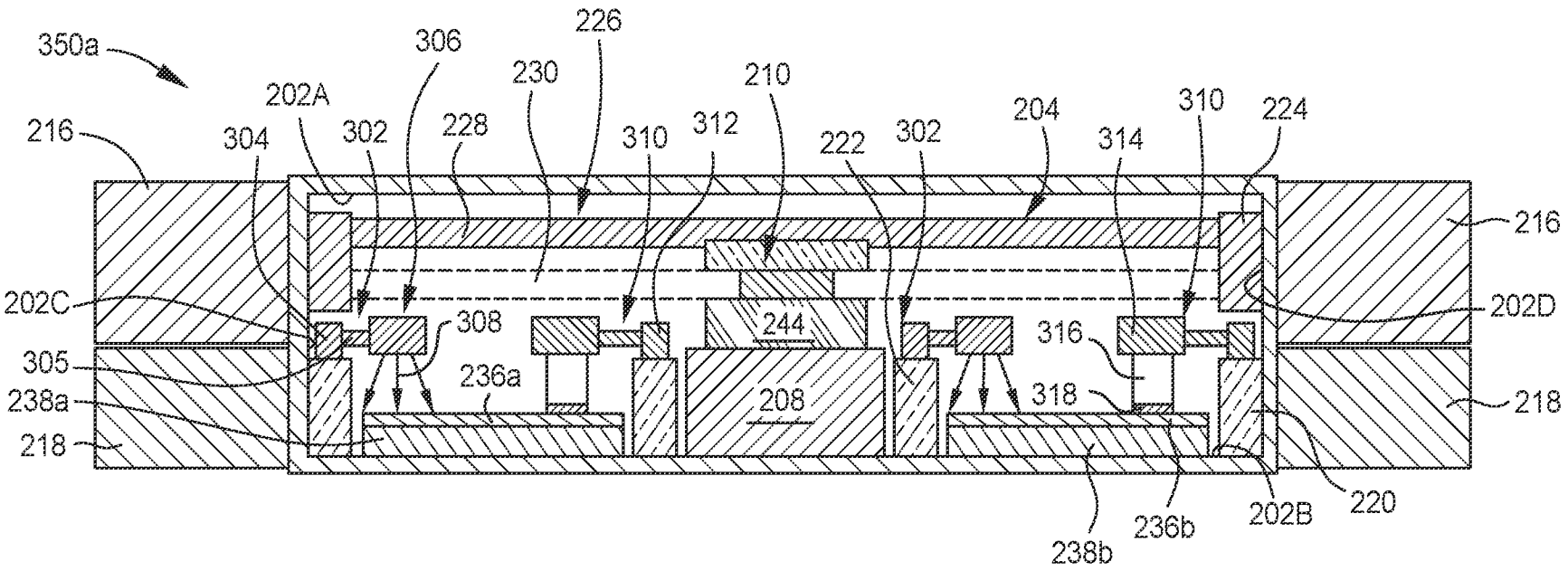
FIG. 3B is a close-up side cross-sectional view of a polishing station illustrated in FIG. 3A, according to one embodiment.

As shown in FIG. 3B, the one or more liquid delivery arms 302 are configured to actuate over each of the platens 238*a*, 238*b* and the respective pads 236*a*, 236*b*. One or more liquid delivery arms 302 are coupled to each of the second auxiliary supports 222 disposed along one side of each platen 238*a*, 238*b*. The one or more liquid delivery arms 302 may be configured to travel along the length of the second auxiliary support 222 or may be stationary.

In embodiments in which the pad conditioner arms 310 is configured to be positioned along the second auxiliary support 222, a conditioner arm base 312 includes an actuator, a motor, or is coupled to a guide which moves along the length of the second auxiliary support 222. The conditioner arm base 312 is further configured to rotate the pad conditioner arm 310 about a conditioner base axis (e.g., vertical axis) that allows a conditioner head 314 to be pivoted thereabout. The pad conditioner arms 310 further include a conditioner head 314 with a mounting plate 316 and a conditioning disk 318. The conditioner head 314 is similar to the pad conditioner 214.

The conditioner head 314 is coupled to the conditioner arm base 312 using a connecting arm 310. The connecting arm 310 is an arm with supports the conditioner head 314 and is pivoted by components within the conditioner arm base 312. The mounting plate 316 is coupled to the bottom of the conditioner head 314 and is configured to support the conditioning disk 318 as the conditioning disk 318 is actuated against one of the pads 236*a*, 236*b* on one of the platens 238*a*, 238*b*. The conditioning disk 318 is used to clean and/or rejuvenate the pads 236*a*, 236*b* by sweeping polishing byproducts therefrom, such as with a brush (not shown), and/or by abrading the pads 236*a*, 236*b* by urging an abrasive pad conditioning disk (e.g., a diamond impregnated disk) there against. Pad conditioning operations may be done between polishing substrates, i.e., ex-situ conditioning, concurrently with polishing a substrate, i.e., in-situ conditioning, or both.

One or more liquid delivery arms 302 are also configured to actuate over each of the platens 238*a*, 238*b* and the respective pads 236*a*, 236*b*. The one or more liquid delivery arms 302 are coupled to each of the first auxiliary supports 220 disposed along the side of the platens 238*a*, 238*b*. The one or more liquid delivery arms 302 may be configured to travel along the length of the first auxiliary support 220 or may be stationary. In embodiments in which the liquid delivery arm 302 is configured to move along the first auxiliary support 220, a delivery arm base 304 includes an actuator, a motor, or is coupled to a guide which moves along the length of the first auxiliary support 220. The delivery arm base 304 further is configured to rotate the liquid delivery arm 302 about a delivery base axis (e.g., vertical axis) that allows a liquid delivery arm 302 to be pivoted thereabout. The delivery arm 302 further includes a delivery head 306. The delivery head 306 extends over one of the platens 238, 238*b* and includes at least one nozzle for delivering a liquid, such as the liquid 308 to the pads 236*a*, 236*b*.

The liquid delivery arm 302 is coupled to one or more fluid sources, such as a fluid source that is coupled to or disposed within the liquid delivery modules 218. In some embodiments, the liquid delivery arm 302 is configured to supply one or both of a polishing fluid (e.g., slurry containing fluid) and a water. The liquid 308 is provided from the liquid delivery arm 302 at a desired flow rate and pressure to a surface of the polishing pad. The liquid delivery arm 302 may provide one or more fluids that include a chemical solution (e.g., acid, base, inhibitor, etc.) and/or slurry containing solution (e.g., abrasive particle (e.g., silica, ceria, or alumina based abrasives) containing solution) used for substrate polishing. The water which may be utilized within the liquid delivery arm 302 is a de-ionized water source. The liquid delivery arm 302 may include a pump or a plurality of pumps (one for each fluid) that are used to deliver a fluid to the surface of the polishing pad.

The liquid 308 provided by the liquid delivery arm 302 is dispensed onto one of the first pad 236*a* or the second pad 236*b*. The liquid 308 is delivered to the first pad 236*a* or the second pad 236*b* as a spray, such that the spray is emitted by a nozzle of the delivery head 306 onto the first pad 236*a* or the second pad 236*b*. The spray can be a continuous stream of liquid, such as a chemical solution, slurry containing solution, or water.

Figure 3C:
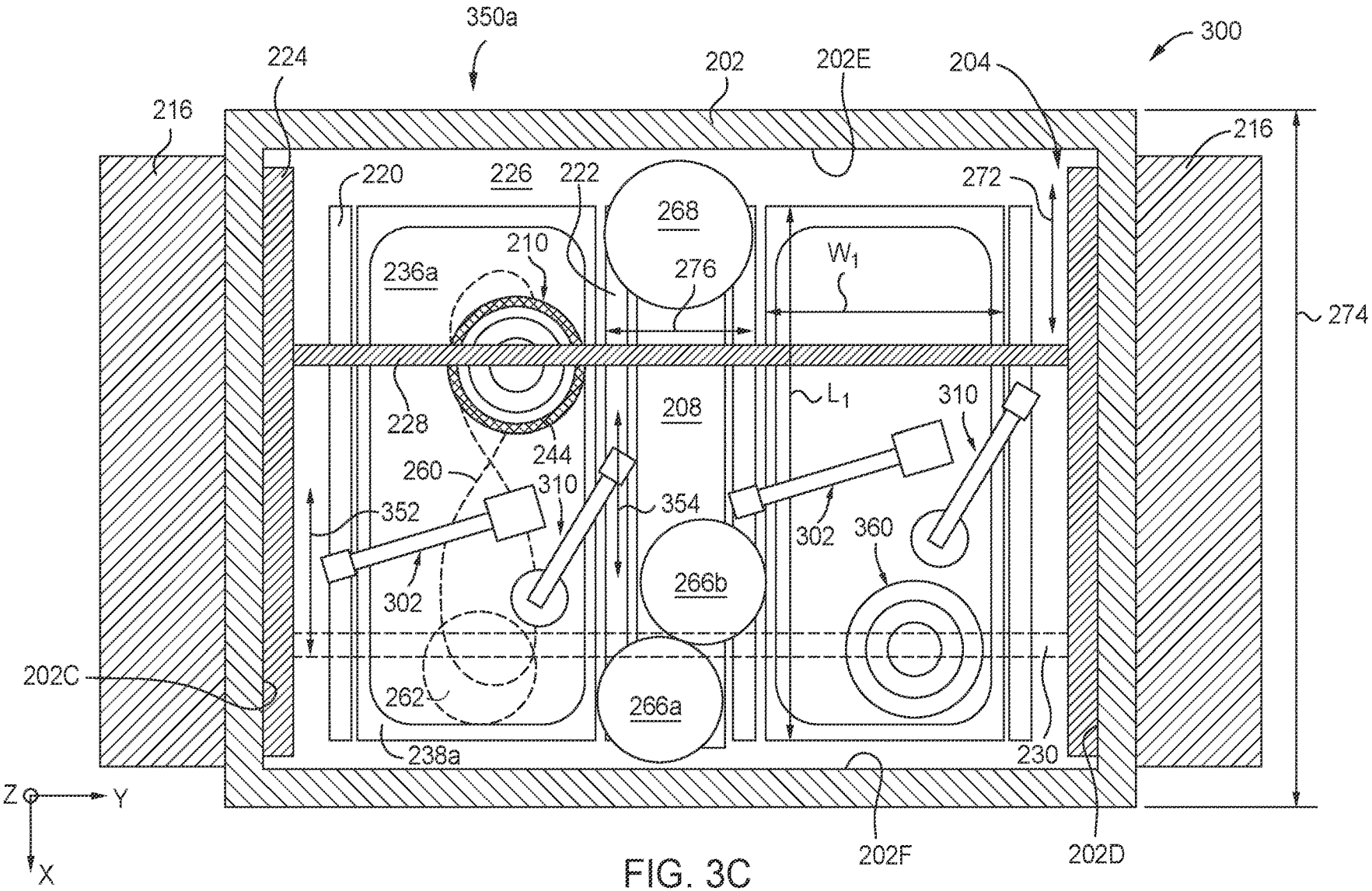
FIG. 3C is a schematic top partial cross-sectional view of the polishing station of FIG. 3B, according to one embodiment.

FIG. 3C is a schematic top partial cross-sectional plan view of the polishing station of FIG. 3B. As shown in FIG. 3C, each of the liquid delivery arms 302 and the pad conditioner arms 310 are actuated along the first auxiliary support 220 and the second auxiliary support 222 respectively. In some embodiments, the pad conditioner arms 310 are configured to perform a pad conditioning process before and/or after a substrate has been polished on the pad 236*a*. Therefore, the liquid delivery arm 302 is actuated in a direction 352 along the length of the first auxiliary support 220 while the pad conditioner arm 310 is actuated in a direction 354 (e.g., +x-direction and −x-direction) along the length of the second auxiliary support 222.

Figure 4A:
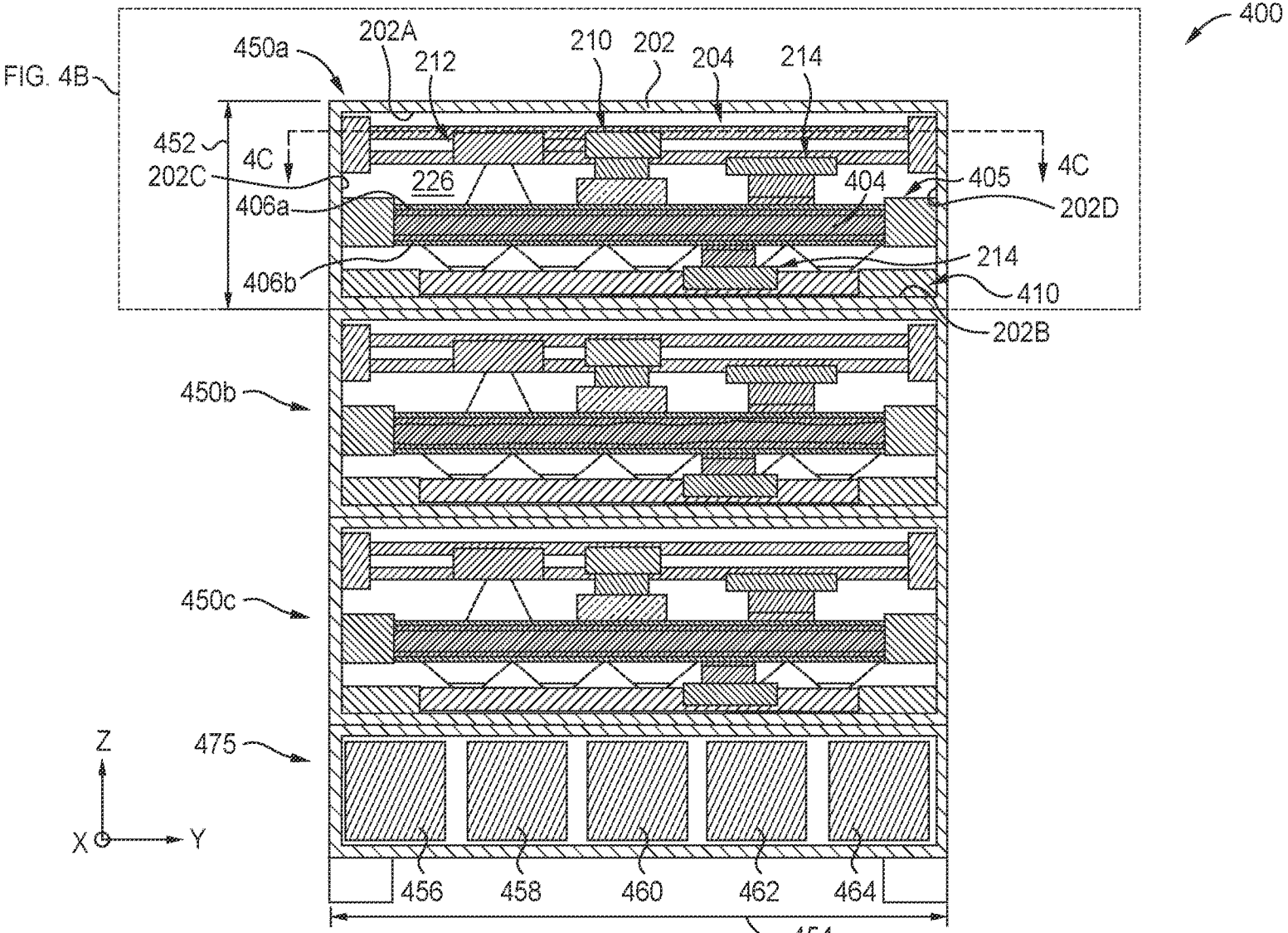
FIG. 4A is a schematic side cross-sectional view of another polishing station, according to one embodiment.

FIG. 4A is a schematic side cross-sectional view of another polishing station 400. The polishing station 400 includes a plurality of polishing modules 450*a*, 450*b*, 450*c*. In some embodiments, there is a first polishing module

450*a*, a second polishing module 450*b*, and a third polishing module 450*c*. Each of the first polishing module 450*a*, the second polishing module 450*b*, and the third polishing module 450*c* are similar and include similar components for processing a substrate. The plurality of polishing modules 450*a*, 450*b*, 450*c* are vertically stackable, such that the footprint of the polishing station 400 is smaller and has an improved substrate throughput density. One or more support modules 475 may be disposed either below or above the stack of polishing modules 450*a*, 450*b*, 450*c*. In some embodiments, the support module 475 is disposed on a side of the polishing modules 450*a*, 450*b*, 450*c* similarly to the electrical or pneumatic component assemblies 216 or the liquid delivery modules 218 of FIGS. 2A-2C.

Figure 4B:
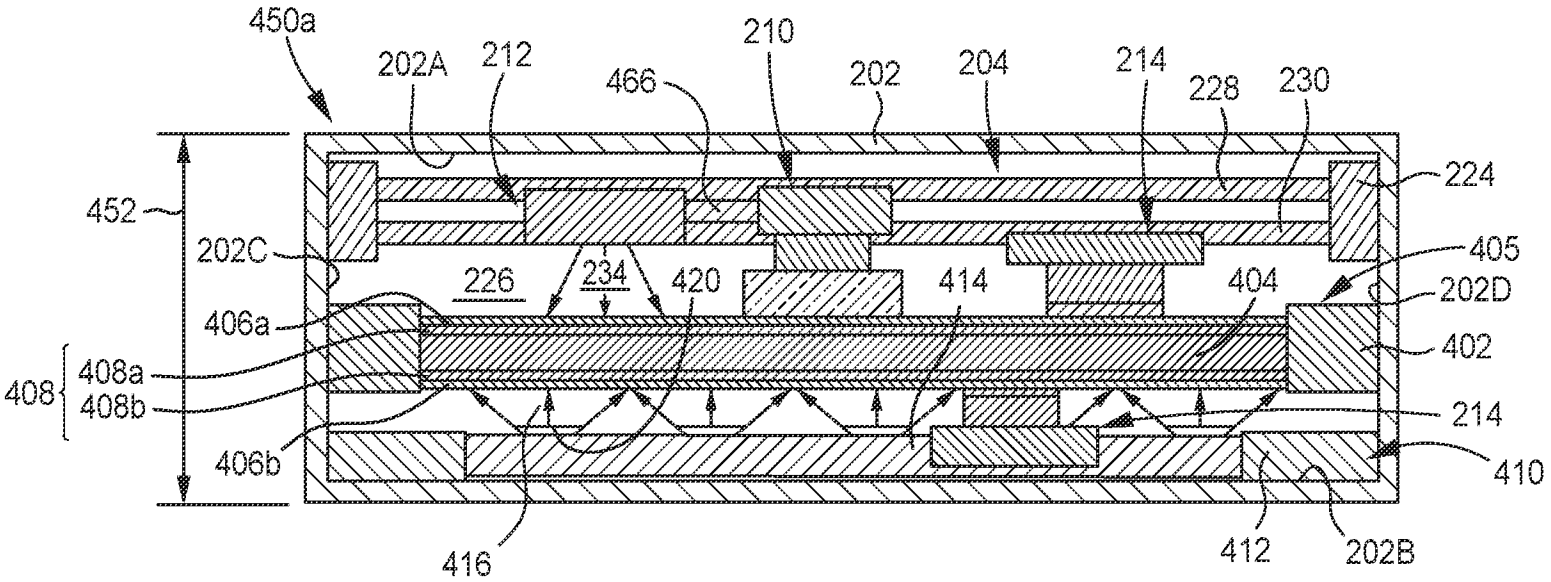
FIG. 4B is a close-up side cross-sectional view of a polishing station illustrated in FIG. 4A, according to one embodiment.

As shown in FIG. 4B, each of the polishing modules 450*a*, 450*b*, 450*c*, 450*d* include the system body 202, the x-y gantry assembly 204, the carrier head assembly 210, the liquid delivery unit 212, one or more pad conditioners 214, a platen 404, a plurality of pads 406*a*, 406*b* disposed on the platen 404, and a pad wash station 410. Each of the system body 202, the x-y gantry assembly 204, the carrier head assembly 210, the liquid delivery unit 212, and one or more pad conditioners 214 are similar to that described in FIGS. 2A-2C. However, in one configuration, the platen 404 is a two sided platen and is configured to support a first pad 408*a* on a first side and a second pad 408*b* on a second side. The pad wash station 410 is disposed on an opposite side of the platen 404 from the x-y gantry assembly 204, the carrier head assembly 210, and the liquid delivery unit 212. The liquid delivery unit 212 may also be mechanically coupled to the carrier head assembly 210 using a liquid delivery arm 466. The liquid delivery arm 466 may enable the liquid delivery unit 212 to be held at a constant distance and position from the carrier head assembly 210 during movement of the carrier head assembly 210. The liquid delivery arm 466 enables the liquid delivery unit 212 to be detached from the x-y gantry assembly 204 and may reduce the complexity of the x-y gantry assembly 204.

The platen 404 has a pad conveyor system 408 disposed thereon. The platen 404 and the pad conveyor system 408 are part of a multi-pad platen assembly 405. The multi-pad platen assembly 405 may be similar to a multi-pad platen assembly 900 of FIGS. 9A and 9B, such that the multi-pad platen assembly 900 may be swapped out with the multi-pad platen assembly 405. The pad conveyor system 408 includes a flexible belt which has a first pad coupling region 408*a* and a second pad coupling region 408*b*. The belt may be configured as a conveyor and is configured to move the first pad 406*a* and the second pad 406*b* between a processing position and a cleaning position. The belt may be similar to the belt 908 of FIGS. 9A and 9B. While positioned in the processing position, the first pad 406*a* or the second pad 406*b* are positioned to face the carrier head assembly 210 and the x-y gantry assembly 204 and are configured to serve as a polishing or a buffing pad. While positioned in the cleaning position, the first pad 406*a* or the second pad 406*b* are positioned to face the pad wash station 410 and are configured to be cleaned or washed simultaneously with processing of a substrate on a pad disposed in the processing position disposed on the opposite side of the platen 404. The pad conveyor system 408 may further include a first roller and a second roller, similar to the first roller 904*a* and the second roller 904*b* of FIG. 9B. The first roller and the second roller spaced apart from one another and respectively disposed on opposite ends of the platen 404 and the pad conveyor system 408 that are aligned along the ±x-directions. The platen 404 may be similar to the platen 905 of the multi-pad platen assembly 900 of FIGS. 9A and 9B. The size of the first roller and the second roller as well as the belt forming the pad conveyor system 408 control the radius of curvature at which the pads 406*a*, 406*b* are configured to be able to endure. One or more belt drives 402 is coupled to the pad conveyor system 408 and is configured to actuate the pad conveyor system 408 between process operations. In some embodiments, the platen 404 is formed of a metal material and may include one or more sub-layers (e.g., coating or removable plate) for supporting the pads 406*a*, 406*b* to further minimize wear and allow the movement of the belt relative to the platen.

The pads 406*a*, 406*b* are indexed between the processing position and the cleaning position by rotating each of the first roller and the second roller. Rotating the first roller and the second roller subsequently indexes the belt since the belt is disposed around and contacting the first roller and the second roller. The pads 406*a*, 406*b* are coupled to the belt and therefore move along with the belt from one side of the platen 404 to the opposite side of the platen 404. The belt may also be contacting the platen 404 on both sides of the platen 404, such that the belt is in tension and contacting each of the first and second rollers as well as the platen 404. Moving the pads 406*a*, 406*b* from one side to the other using the pad conveyor system 408 enables one of the pads 406*a*, 406*b* to be utilized for substrate processing while simultaneously washing the other of the pads 406*a*, 406*b*. The pad conveyor system 408 is also compact and enables for a reduced size of the polishing modules 450*a*, 450*b*, 450*c*, 450*d*. The location of the platen 404 within the pad conveyor system 408 enables efficient indexing of the pads 406*a*, 406*b* while enabling the pads 406*a*, 406*b* to have pressure applied thereon during processing.

The pad wash station 410 includes two wash runway beams 410 coupled to the inside sidewalls 202C and 202D of the system body 202. The pad wash station 410 further includes a wash cross-beam 414 disposed between the two wash runway beams 410. The wash cross-beam 414 includes a plurality of nozzles 420 disposed thereon which are oriented towards the bottom side of the platen 404. The plurality of nozzles 420 are configured to dispense a cleaning fluid 416, such as water, onto a pad disposed on the bottom side of the platen 404, such as the second pad 406*b* when it is disposed in the cleaning position. Each of the nozzles 420 are coupled to a fluid source, such as fluid source coupled to or disposed within a liquid delivery module. The wash cross-beam 414 is similar to one of the cross beams 228, 230 of the x-y gantry assembly 204 in that the wash cross-beam 414 is configured to actuate along the length of the wash runway beams 410.

Referring back to FIG. 4A, the support module 475 includes one or more liquid delivery modules 456, 458, 460, and one or more electrical or pneumatic components 462, 464. The liquid delivery modules 456, 458, 460 are similar to the liquid delivery modules 218 of FIGS. 2A-2C, 3A-3C. The one or more electrical or pneumatic components 462, 464 are similar to the electrical or pneumatic component assemblies 216 of FIGS. 2A-2C, 3A-3C.

Figure 4C:
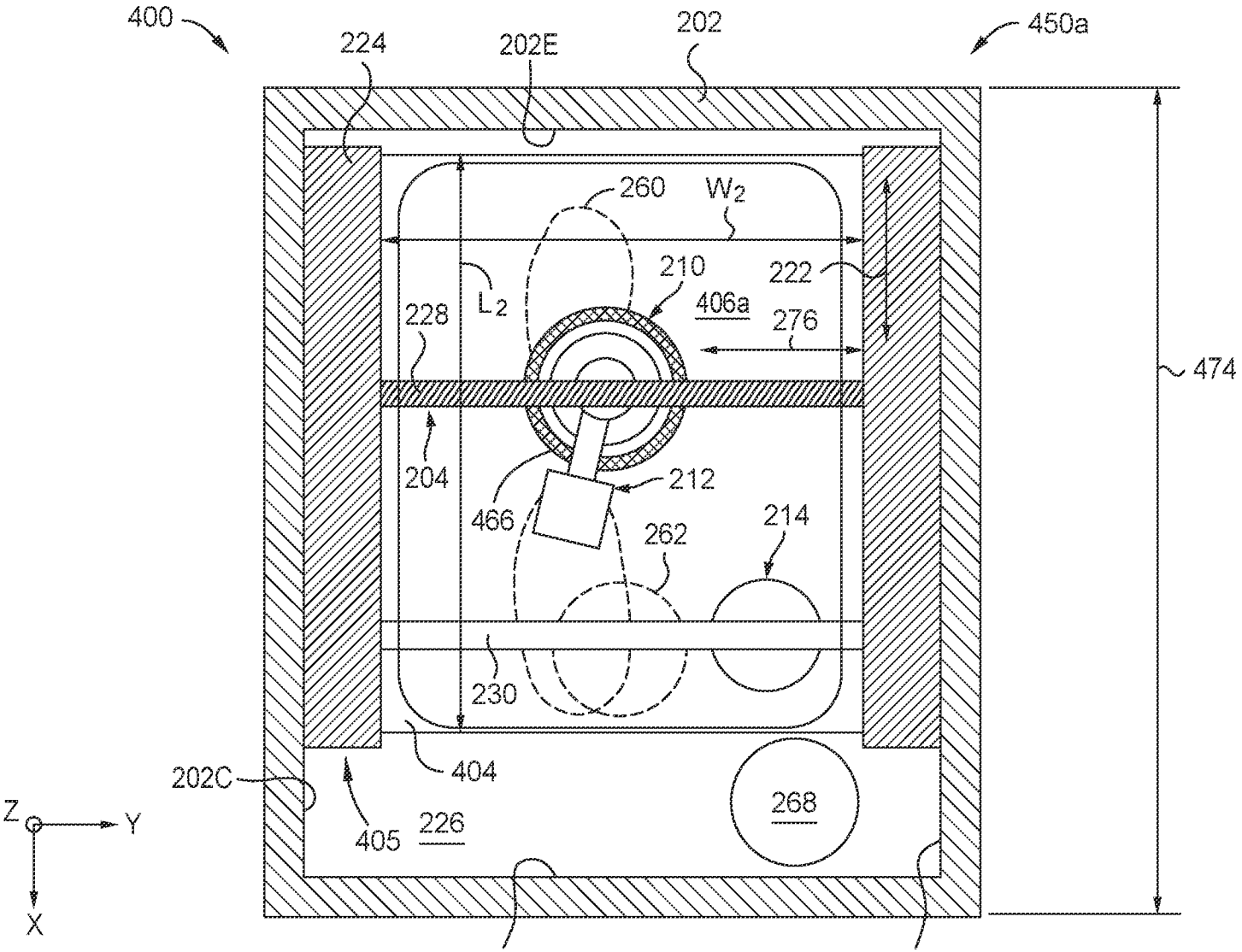
FIG. 4C is a schematic top partial cross-sectional view of the polishing station of FIG. 4B, according to one embodiment.

FIG. 4C is a schematic top partial cross-sectional plan view of the polishing station 400 of FIG. 4B. Each of the polishing modules 450*a*, 450*b*, 450*c* further include the carrier loading station 268 on a distal end of the platen 404. As discussed with respect to FIGS. 2A-2C, the carrier head assembly 210 is actuated along the pre-determined pattern 260 over the first pad 406*a* and/or the second pad 406*b*.

The platen 404 has a rectangular shape in the plan view, such that the top surface of the platen 404 on which a pad is disposed is rectangular. In some embodiments, the corners of the rectangle may be chamfered or rounded. The rectangular shaped platen is configured to receive a polishing pad that has a polishing surface that is non-axisymmetric, such as a polishing pad that is not circular shaped or round. In one example, the non-axisymmetric polishing pad has a rectangular shape that is flush with or circumscribes the edges of the platen 404. In some embodiments, the top surface of the platen 404 is ovoid in shape. In some embodiments, the platen 404 has a second length $L_2$ and a second width $W_2$. The second length $L_2$ is the length of the platen 404 in the x-direction. The second width $W_2$ is the width of the platen 404 in the y-direction. The second length $L_2$ is greater than the second width $W_2$, such as about 1.5 times greater, such as about 2 times greater, such as about 2.5 times greater, such as about 3 times greater. Therefore, the aspect ratio of the second length $L_2$ to the second width $W_2$ of the platen 404 is greater than about 1.5:1, such as greater than about 2:1, such as greater than about 2.5:1, such as greater than about 3:1. The increased second length $L_2$ relative to the second width $W_2$ improves the ability to create a variety of polishing patterns, such as the leminiscate pattern. In some embodiments, the pad conditioner 214 is configured to perform a pad conditioning process before and/or after a substrate has been polished on the pad 236*a*.

Each of the polishing modules 450*a*, 450*b*, 450*c*, has a module height 452, a module width 454, and a module length 474. The module height 452 is the height of one of the polishing modules 450*a*, 450*b*, 450*c* in the z-direction normal to the x-direction and the y-direction. The module width 454 is the width of one of the polishing modules 450*a*, 450*b*, 450*c* in a y-direction normal to the x-direction and the z-direction. The module length 474 is the length of one of the polishing modules 450*a*, 450*b*, 450*c*. The module height 452 is less than about 2000 mm, such las less than about 1500 mm, such as less than about 1250 mm, such as less than about 1000 mm. The module width 454 is less than about 3000 mm, such as less than about 2500 mm. The module length 474 is about 1000 mm to about 2500 mm, such as about 1000 mm to about 2000 mm, such as about 1100 mm to about 1500 mm, such as about 1150 mm to about 1250 mm.

The dimensions of each of the polishing modules 450*a*, 450*b*, 450*c* enable each of the polishing modules 450*a*, 450*b*, 450*c* to be smaller than a traditional chemical mechanical polishing assembly. The module height 452, module width 454, and module length 474 further enable vertical stacking of the polishing modules 450*a*, 450*b*, 450*c*. By not rotating the carrier head assembly 210 or the platen 404, the amount of rotary devices within the polishing modules 450*a*, 450*b*, 450*c* is decreased as rotary devices add complexity to the system and often need to be replaced. Therefore, by not utilizing a rotating carrier head assembly 210, smaller polishing module 450*a*, 450*b*, 450*c* dimensions are enabled. In this configuration, the polishing modules 450*a*, 450*b*, 450*c* are greatly simplified and thus will have a greater reliability, easier to maintain and are much less costly versus conventional CMP polishing hardware designs that require the polishing pad and portions of the carrier head to be simultaneously separately rotated and translated relative to each other.

Figure 5:
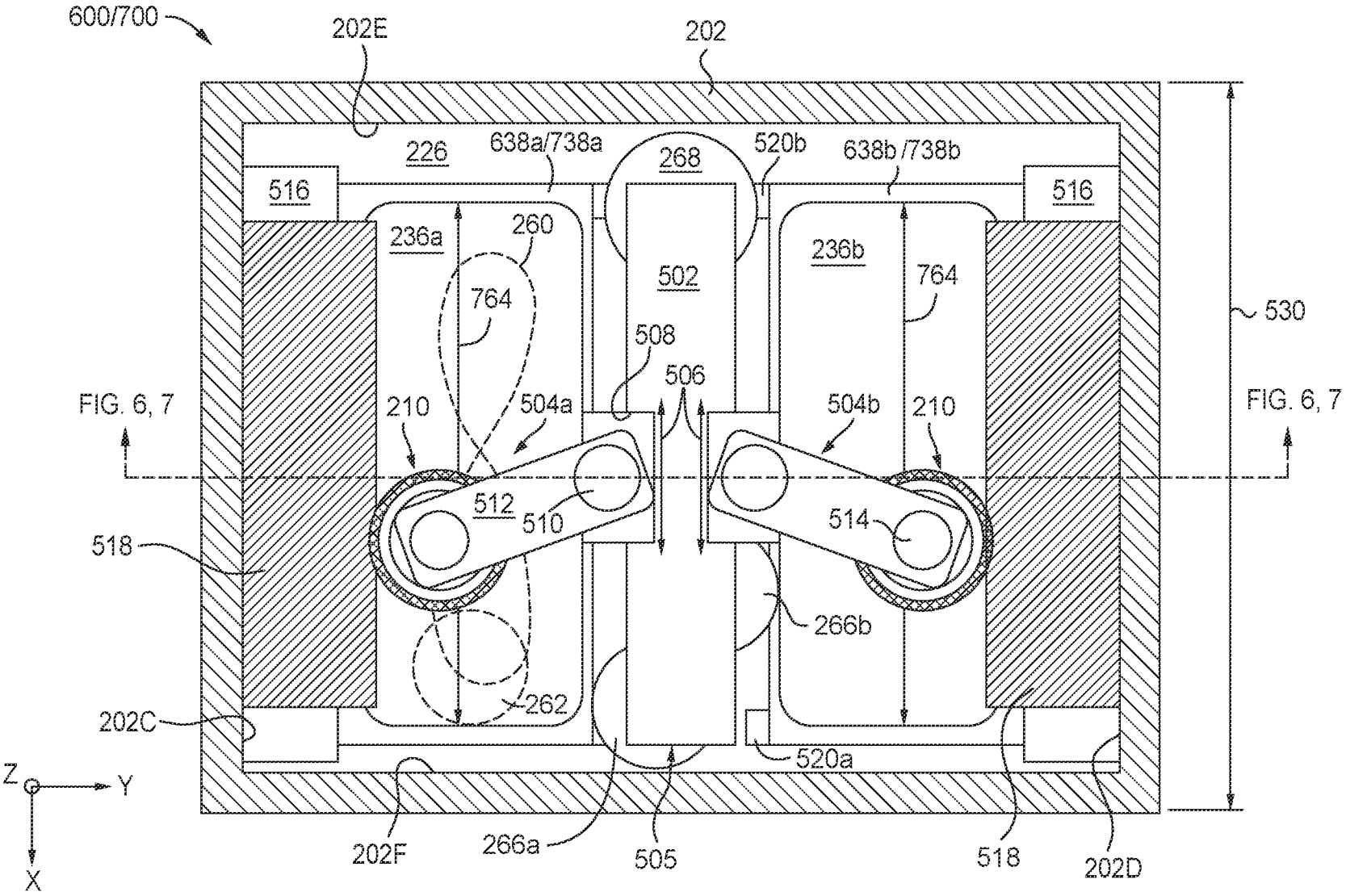
FIG. 5 is a schematic top partial cross-sectional view of yet another polishing station, according to one embodiment.
Figure 6:
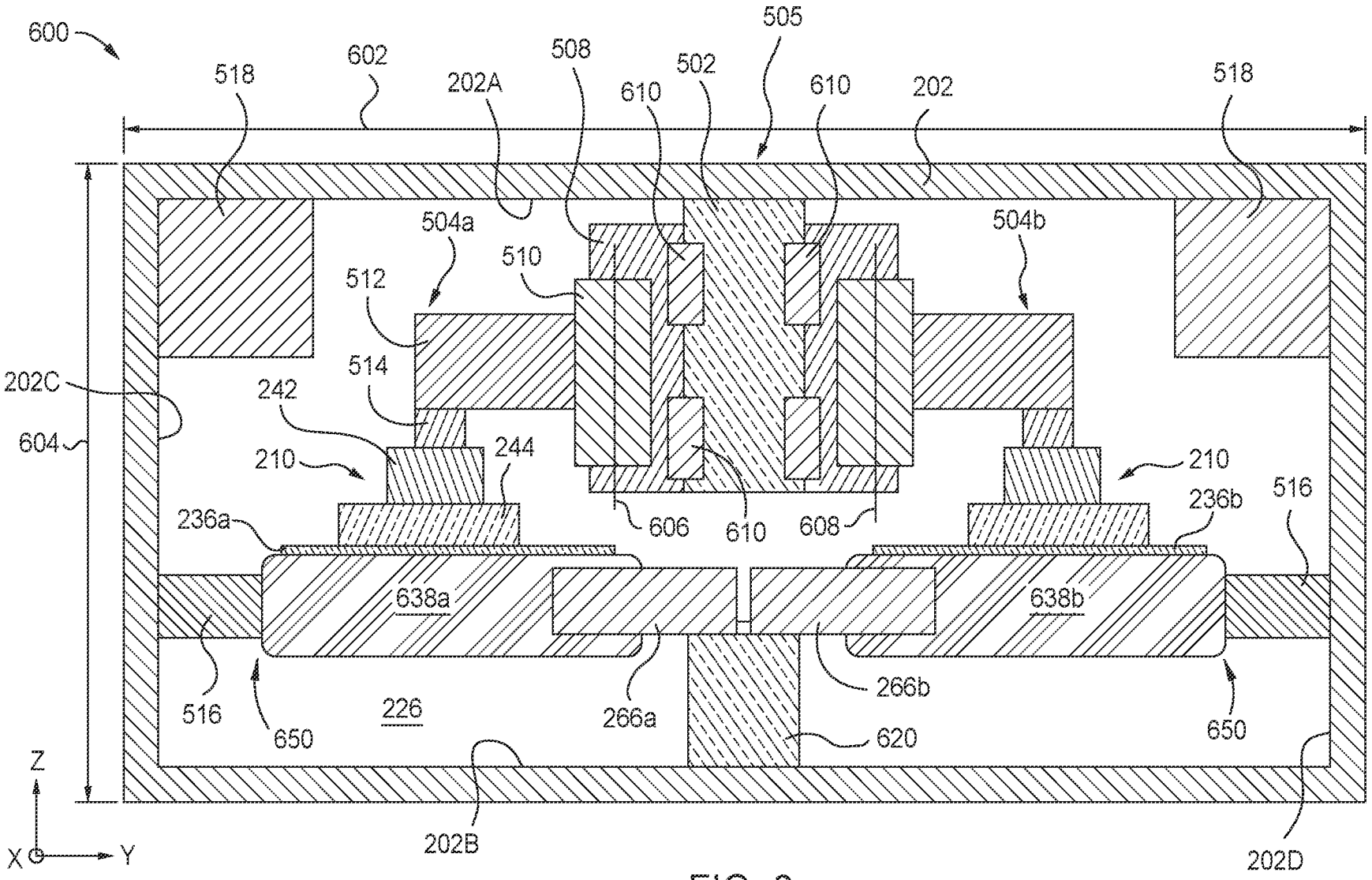
FIG. 6 is a schematic side cross-sectional view of a polishing station, according to one embodiment.
Figure 7:
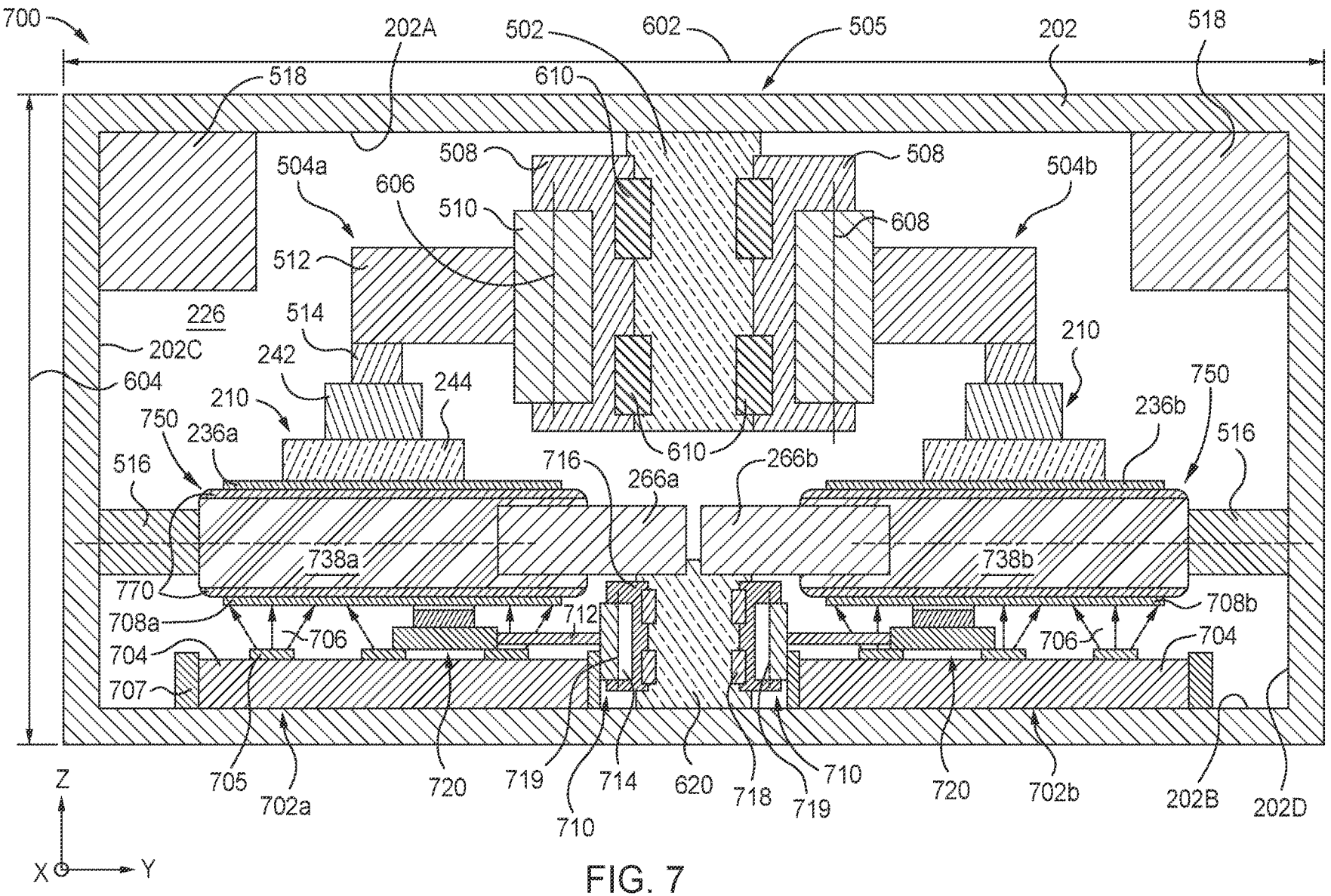
FIG. 7 is a schematic side cross-sectional view of another polishing station, according to one embodiment.

FIG. 5 is a schematic top partial cross-sectional view of a polishing station 600 or a polishing station 700, which are illustrated in FIGS. 6 and 7. The polishing stations 600, 700 may be used in place of one of the polishing stations 200, 300, 400 of FIGS. 2A-4C. In some embodiments, the polishing stations 600, 700 may be integrated within the polishing stations 200, 300, 400 of FIGS. 2A-4C, such that the polishing stations 600, 700 are one or more of the polishing modules 250*a*, 250*b*, 250*c*, 250*d*, 350*a*, 350*b*, 350*c*, 350*d*, 450*a*, 450*b*, 450*c* and are stacked. Both of the polishing station 600 and the polishing station 700 include a head actuation assembly 505, a plurality of liquid delivery modules 518, the carrier load station 268, the first head wash 266*a*, the second head wash 266*b*, and a plurality of platens. In the polishing station 600 of FIG. 6, the platens are stationary platens 638*a*, 638*b*. In the polishing station 700 of FIG. 7, the platens are multi-pad support platens 738*a*, 738*b*.

FIG. 6 is a schematic side cross-sectional view of a polishing station 600. As shown in the embodiment of FIG. 6, each of the head assemblies 504*a*, 504*b* are coupled to the central rail support 502 using two rails 610 each. The rails 610 extend along the length of the central rail support 502. The rotation axes 606, 608 of the rotation shafts 510 are also shown, such that first head assembly 504*a* has a first rotation shaft 510 with a first rotation axis 606 and the first head assembly 504*a* actuates around the rotation axis 606. In some embodiments, the first head assembly 504*a* and second head assembly 504*b* may each be actuated by use of a rotational motor (not shown) that is configured position and generate angular movement of the first head assembly 504*a* and second head assembly 504*b* about their respective rotation axes 606, 608. The second head assembly 504*b* has a second rotation shaft 510 with a second rotation axis 608 and the second head assembly 504*b* actuates around the rotation axis 608. The platens 638*a*, 638*b* of the polishing station 600 are not configured to be actuated and are fixedly positioned, such that the pads 236*a*, 236*b* are similarly utilized as those of FIGS. 2A-2C.

FIG. 7 is a schematic side cross-sectional view of another polishing station 700. The polishing station 700 includes the multi-pad support platens 738*a*, 738*b*, such that the polishing station 700 includes a first platen 738*a* which is configured to support pads on opposite sides thereof as well as a second platen 738*b* configured to support pads on opposite sides. The polishing station 700 further includes one or more pad wash stations 702*a*, 702*b*.

Referring back to FIG. 5, both of the polishing station 600 and the polishing station 700 may further include liquid delivery and conditioning arms disposed on the head actuation assembly 505, such that the liquid delivery and conditioning arms are coupled to separate guide rails positioned along a central rail support 502. The central rail support 502 extends along the length of the upper inner sidewall 202A. The central rail support 502 includes a metal beam configured to support one or more head assemblies 504*a*, 504*b*. In some embodiments, a first head assembly 505 is coupled to a first side of the beam while a second head assembly 505 is coupled to a second side of the beam. The central rail support 503 includes grooves along which the head assemblies 504*a*, 504*b* may be actuated and may further include power and fluid delivery lines (not shown) disposed therethrough. The liquid delivery and conditioning arms are similar to the liquid delivery arms 302 and the pad conditioner arms 310 of FIGS. 3A-3C. The pad conditioner arms 310 may also be similar to the pad conditioner 720 of FIG. 7.

The head actuation assembly 505 includes a first head assembly 504*a* and a second head assembly 504*b*. Each of the first head assembly 504*a* and the second head assembly 504*b* are similar and disposed on opposite sides of a central rail support 502. The central rail support 502 is coupled to the upper inner sidewall 202A of the system body 202 and is disposed along the length of the platens within the process volume 226. The first head assembly 504*a* extends over a first platen, such as the first platen 638*a* or the first platen 738*a*. The second head assembly 504*b* extends over a second platen, such the first platen 638*b* or the first platen 738*b*.

Each of the head assemblies 504*a*, 504*b* are configured to actuate a carrier head assembly 210 which is coupled to a distal end thereof. The head assemblies 504*a*, 504*b* further include a linear actuator 508 connected to the central rail support 502 and a support arm 512 coupling the carrier head assembly 210 to the linear actuator 508. The linear actuator may include a linear motor, leadscrew, ball screw, rack and pinion, chain drive, belt drive, or other similar device that is configured to translate a component back-and-forth in a linear direction. The support arm 512 is coupled to a rotation shaft 510 disposed through an inner distal end of the support arm 512. The rotation shaft 510 is further disposed on or through a portion of the linear actuator 508 and may include a motor or pneumatic assembly coupled thereto to enable the support arm 512 and the carrier head assembly 210 to be swung about the rotation shaft 510 and thus translated within the x-y plane. A head support shaft 514 is disposed through the distal end of the support arm 512 opposite the rotation shaft 510. The head support shaft 514 supports the carrier head assembly 210 and couples the carrier head assembly 210 to the support arm 512.

Both of the head assemblies 504*a*, 504*b* are able to be coupled together or controlled independently by use of commands delivered from the system controller 170. In some embodiments, the head assemblies 504*a*, 504*b* are independently controlled, such that the head assemblies 504*a*, 504*b* are actuated along the lengthwise direction 506 of the central rail support 502 and pivoted by use of a rotational actuator (e.g., stepper motor) about the rotation shaft 510 separately. In some embodiments, as illustrated in FIGS. 6-8B, the head assemblies 504*a*, 504*b* are actuated along the central rail support 502 by use of a linear actuator that may include a linear motor, leadscrew, ball screw, rack and pinion, chain drive, belt drive, or other similar device that is configured to translate a component back-and-forth in a linear direction. Each of the head assemblies 504*a*, 504*b* are coupled to one or more rails 610 on either side of the central rail support 502 (FIG. 6). The one or more rails 610 enable the head assemblies 504*a*, 504*b* to be actuated along the length of the central rail support 502. Actuation of the head assemblies 504*a*, 504*b* along the length of the central rail support 502 enables a wide range of polishing patterns, such that the head assemblies 504*a*, 504*b* may be moved in a path which promotes uniform polishing of the substrate. The movement further enables the polishing stations 600, 700 to perform a polishing process without the need to rotate the carrier head assemblies. The use of non-rotating carrier head assemblies reduces the complexity of the system, reduces the likelihood of mechanical failure, and reduces the overall size of the system. Thus, in some embodiments, the linear actuator is the only means to generate relative motion between the carrier head and a non-axisymmetric polishing pad disposed on the rectangular pad supporting surface.

Each of the liquid delivery modules 518 are disposed over a portion of one of the platens 638*a*, 638*b* or the platens 738*a*, 738*b*. The liquid delivery modules 518 are similar to the liquid delivery modules 218 of FIGS. 2A-2C. The liquid delivery modules 518 are coupled to an inside side surface of the system body 202 and may also be coupled to the inside top surface of the system body 202. The liquid delivery modules 518 may alternatively be located outside of the system body 202 and one or more polishing stations 600, 700 may share the same liquid delivery modules 518.

Each of the carrier load station 268, the first head wash 266*a*, and the second head wash 266*b* are disposed between the platens 638*a*, 638*b* or the platens 738*a*, 738*b* similarly to in the embodiments of FIGS. 2A-2C. As shown in FIG. 6, the carrier load station 268, the first head wash 266*a*, the second head wash 266*b* are supported by a central support 620, which is similar to the central support 208 of FIGS. 2A-2C.

The platens 638*a*, 638*b* of the polishing station 600 are stationary and thus are not configured to move relative to the walls of the processing module during or between process operations. However, the pads coupled to each of the platens 738*a*, 738*b* of the polishing station 700 are configured to be moved between process operations, such that the pads disposed on an upper surface of the platens 738*a*, 738*b* which face the head assemblies 504*a*, 504*b* are swapped with different pads which have been cleaned and/or conditioned. Each of the platens 638*a*, 638*b* and the platens 738*a*, 738*b* are coupled to a platen support 516. In some embodiments, the platen support 516 is coupled to a side surface of each of the platens 638*a*, 638*b* and the platens 738*a*, 738*b* and the first inner sidewall 202*c* of the system body 202. The platen support 516 provides mechanical support for each of the platens 638*a*, 638*b* and the platens 738*a*, 738*b*. The assembly of the platen support 516 and one of the platens 638*a*, 638*b* forms a platen assembly 650. The assembly of the platen support 516 and one of the platens 738*a*, 738*b* forms a multi-pad platen assembly 750. The platen support 516 may be a cantilevered support, such that only one side of the platen support 516 is mechanically coupled to the system body 202 and the end of the platen support 516 to which the platens 638*a*, 638*b*, 738*a*, 738*b* are couples is free-hanging. Alternatively, a platen support 516 is disposed on either side of each of the platens 638*a*, 638*b*, 738*a*, 738*b* and supports both sides of the platens 638*a*, 638*b*, 738*a*, 738*b*. In embodiments in which there are two platen supports 516 for each of the platens 638*a*, 638*b*, 738*a*, 738*b*, the platen assembly 650, 750 is coupled to both the first inner sidewall 202*c* and a side of the central support 620.

In the polishing station 700 of FIG. 7, the platen support 516 may further include a belt drive similar to the belt drive 402 of FIGS. 4A-4C. In embodiments in which the platen support 516 includes a belt drive 402, the platen support 516 further includes a first roller 510*a* and a second roller 520*b* spaced apart from one another and respectively disposed on opposite ends of the platens 738*a*, 738*b*. The first roller 510*a* and the second roller 520*b* form part of a conveyor system, which includes a belt 770 disposed around each of the platens 738*a*, 738*b* and is configured to be rotated by the first roller 510*a* and the second roller 520*b*. The assembly of each of the platen supports 516, one of the platens 738*a*, 738*b*, rollers 510*a*, 510*b*, and the belt 770 form a multi-pad platen assembly 750. There are two multi-pad platen assemblies 750 within the process volume 226 of the polishing station 700. The multi-pad platen assembly 750 enables the indexing of two or more pads about a single platen 738*a*, 738*b*. The belt 770 moves in a roll direction 764 which is parallel to the lengthwise direction 506.

Each belt 770 is disposed around the first roller 510*a*, the second roller 520*b*, and one of the platens 738*a*, 738*b*. One or more pads are coupled to each of the belts 770. The pads are indexed between a processing position and a cleaning position by rotating each of the first roller 510*a* and the second roller 510*b*. The processing position and the cleaning position are similar to the processing position of FIGS.

4A-4C. Rotating the first roller 510*a* and the second roller 510*b* subsequently indexes the belt 770 since the belt 770 is disposed around and contacts the first roller 510*a* and the second roller 510*b*. The pads are coupled to the belt 770 and therefore move along with the belt 770 from one side of the platen 738*a*, 738*b* to the opposite side of the platen 738*a*, 738*b*. The belt 770 may also be contacting the platen 738*a*, 738*b* on both sides of the platen 738*a*, 738*b*, such that the belt 770 is in tension and contacting each of the first roller 510*a* and second roller 510*b* as well as one of the platens 738*a*, 738*b*. Moving the pads from one side to the other using the belt 770 and the rollers 510*a*, 510*b* enables one of the pads disposed on the belt 770 to be utilized for substrate processing while simultaneously washing the other of the pads. The pad conveyor system is also compact and enables for a reduced size of the polishing modules 450*a*, 450*b*, 450*c*, 450*d*. The location of the platen 404 within the pad conveyor system 408 enables efficient indexing of the pads 406*a*, 406*b* while enabling the pads 406*a*, 406*b* to have pressure applied thereon during processing.

The polishing station 600 has a station height 604, a station width 602 (FIG. 6), and a station length 530. The station height 604 is the height of the polishing station 600 in the z-direction normal to the x-direction and the y-direction. The station width 602 is the width of one of the polishing stations 600 in a y-direction normal to the x-direction and the z-direction. The station length 530 is the length of one of the polishing stations 600. The station height 604 is less than about 2000 mm, such as less than about 1500 mm, such as less than about 1250 mm, such as less than about 1050 mm, such as less than about 1000 mm. The station width 602 is less than about 3500 mm, such as less than about 3000 mm, such as less than about 2750 mm, such as less than about 2500 mm. The station length 530 is about 1000 mm to about 2500 mm, such as about 1000 mm to about 2000 mm, such as about 1000 mm to about 1500 mm, such as about 1100 mm to about 1250 mm.

The platens 638*a*, 638*b*, 738*a*, 738*b* each have a rectangular shape in the plan view, such that the top surfaces of each of the platens 638*a*, 638*b*, 738*a*, 738*b* on which a pad is disposed are rectangular. In some embodiments, the corners of the rectangle may be chamfered or rounded. In some embodiments, the top surfaces of the platens 638*a*, 638*b*, 738*a*, 738*b* are ovoid in shape. In some embodiments, each of the platens 638*a*, 638*b*, 738*a*, 738*b* has a first length $L_1$ and a first width $W_1$ as described in FIGS. 2A-3C and similar benefits as described therein.

The dimensions of each of the polishing stations 600 are smaller than a traditional chemical mechanical polishing assembly. The station height 604, station width 602, and station length 530 further enable stacking of multiple polishing stations 600. By not rotating the carrier head assembly 210 or the platens 638*a*, 638*b*, the amount of rotary devices within the polishing stations 600 is decreased. As rotary devices are often bulky, the removal of rotary devices enables smaller polishing station 600 dimensions. In this configuration, the polishing station 600 is greatly simplified and thus will have a greater reliability, is easier to maintain, and is much less costly versus conventional CMP polishing hardware designs that require the polishing pad and portions of the carrier head to be simultaneously separately rotated and translated relative to each other. The polishing station 600 of FIG. 6 further reduces the mechanical complexity compared to the embodiments of FIGS. 2A-4C. By providing a single pivot point of each head assembly 504*a*, 504*b* at the rotation shafts 510 as well as a single set of rails 610 along which the head assemblies 504*a*, 504*b* are actuated, a similar range of motion to that of the x-y gantry assembly 204 is enabled without any moving components being positioned directly over the polishing pad which could create particles and also increase the chances that the moving components would be exposed to the processing chemistry. Not having the moving components directly over the polishing pad reduces the amount of contaminants which may fall on the polishing pad while still enabling range of motion of each head assembly 504*a*, 504*b*.

Referring to FIG. 7, the first platen 738*a* has a first pad 236*a* on a first side and a second pad 708*a* on a second side of the first platen 738*b* opposite the first side. The second pad 708*a* is one of a polishing pad or a buff pad. The second platen 738*b* has a first pad 236*b* on a first side and a second pad 708*b* on a second side of the second platen 738*b* opposite the first side. The second pad 708*b* is one of a polishing pad or a buff pad. In some embodiments, the first pad 236*b* and the second pad 708*b* disposed on the second platen 738*b* are referred to as a third pad and a fourth pad respectively to distinguish the first pad 236*b* and the second pad 708*b* from the first pad 236*a* and the second pad 708*a* on the first platen 738*a*. A first belt 770 is configured to index the first pad 236*a* and the second pad 708*a* to periodically swap the positions of the pad 236*a* and the pad 708*a*. A second belt 770 is disposed around the platen 738*b* and is configured to index the first pad 236*b* and the second pad 708*b* to periodically swap the positions of the pad 236*b* and the pad 708*b*. The first pad 236*a* and the second pad 708*a* are indexed between process operations, such that the first pad 236*a* and the second pad 708*a* are held in place during a process operation.

In some embodiments, each of the first platen 738*a* and the second platen 738*b* have one of a polishing pad and a buff pad disposed thereon, such that multiple processes are performed on a substrate within the same polishing station 700. In other embodiments, each of the first platen 738*a* and the second platen 738*b* have two different polishing pads disposed thereon which are both configured to polish a substrate, but have different chemical or mechanical characteristics (e.g., polishing surface hardness, different groove patterns, material compositions, etc.). In the polishing station 700, one of the first pad 236*a* or the second pad 708*a* are used to process a substrate while the other of the first pad 236*a* or the second pad 708*a* is washed and/or cleaned. Processing the substrate includes polishing or buffing the substrate. Similarly, one of the first pad 236*b* or the second pad 708*b* of the second platen 738*b* are used to process a substrate while the other of the first pad 236*b* or the second pad 708*b* is washed and/or cleaned.

In the configuration of FIG. 7, the polishing station 700 is greatly simplified and thus will have a greater reliability, is easier to maintain, and is much less costly versus conventional CMP polishing hardware designs that require the polishing pad and portions of the carrier head to be separately rotated and translated relative to each other simultaneously. The polishing station 700 of FIG. 7 further reduces the mechanical complexity compared to the embodiments of FIGS. 4A-4C. By providing a single pivot point of each head assembly 504*a*, 504*b* at the rotation shafts 510 as well as a single set of rails 610 along which the head assemblies 504*a*, 504*b* are actuated, a similar range of motion to that of the x-y gantry assembly 204 is enabled without any moving components being positioned directly over the polishing pad which could create particles and also increase the chances that the moving components would be exposed to the processing chemistry. Not having the moving components directly over the polishing pad reduces the amount of contaminants which may fall on the polishing pad while still enabling range of motion of each head assembly 504*a*, 504*b*. The polishing station 700 is further improved over the polishing station 600 of FIG. 6 in that the polishing station 700 enables multiple pads to be disposed on the platens 738*a*, 738*b* and for the pads to be indexed. Utilizing multiple pads on a single platen 738*a*, 738*b* enables one of the pads to be used for polishing while the other is cleaned simultaneously. Therefore, downtime of the polishing station 700 due to pad cleaning is greatly reduced.

Washing and/or cleaning of the pads 236*a*, 236*b*, 708*a*, 708*b* is performed using the pad wash stations 702*a*, 702*b*. The pad wash stations 702*a*, 702*b* both include two wash runway beams 707 coupled to a sidewall, such as the bottom inner sidewall 202B, of the system body 202. The pad wash stations 702*a*, 702*b* further includes a wash cross-beam 704 disposed between the two wash runway beams 707. The wash cross-beam 704 includes a plurality of nozzles 705 disposed thereon which are oriented towards the bottom side of one of the platens 738*a*, 738*b*. The plurality of nozzles 705 are configured to dispense a cleaning fluid 706, such as water, onto a pad disposed on the bottom side of the platens 738*a*, 738*b*, such as the second pads 708*a*, 708*b*. Each of the nozzles 705 are coupled to a fluid source, such as a liquid delivery unit. The wash cross-beam 704 is similar to one of the cross beams 228, 230 of the x-y gantry assembly 204 in that the wash cross-beam 704 is configured to actuate along the length of the wash runway beams 707 under the bottom surface of each of the platens 738*a*, 738*b*.

The pad wash stations 702*a*, 702*b* each further include a conditioner arm 710. Each of the conditioner arms 710 further includes a pad conditioner 720, a connecting arm 712, a conditioner rotation shaft 714, a linear conditioner actuator 716, and one or more conditioner rails 718 disposed in the side of the central support 620. The pad conditioner 720 is similar to one of the pad conditioners 214 or the conditioner head 314.

At least one conditioner arm 710 is configured to be used with each pad wash station 702*a*, 702*b*. The conditioner arms 710 are configured to actuate along the length of the central support 620 to reach a full length of the polishing pad and also swing about a conditioner rotation axis 719 disposed through each of the conditioner rotation shafts 714. The combination of swinging about the conditioner rotation axis 719 and linear motion along the conditioner rails 718 enables the pad conditioner 720 to reach all desired areas of a pad coupled to one of the platens 738*a*, 738*b*.

The connecting arm 712 is coupled to the conditioner rotation shaft 714, such that the conditioner rotation shaft 714 is disposed through an inner distal end of the connecting arm 712. The condition rotation shaft 714 is further disposed through a portion of the linear conditioner actuator 716 and may include a motor or pneumatic assembly coupled thereto to enable the connecting arm 712 and the pad conditioner 720 to be swung about the conditioner rotation axis 719. The pad conditioner 720 is coupled to a distal end of the connecting arm 712 opposite the conditioner rotation shaft 714.

Figure 8A:
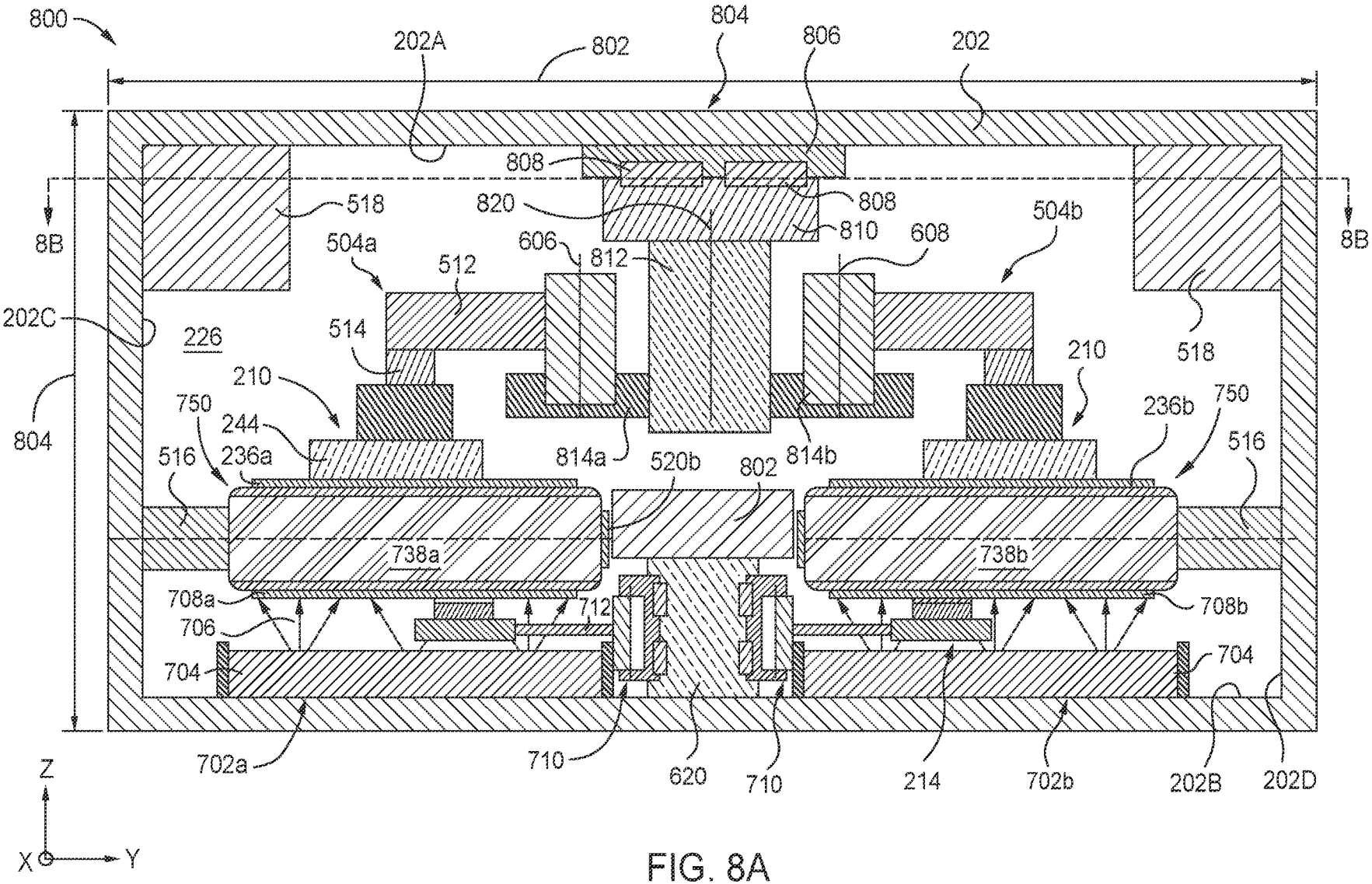
FIG. 8A is a schematic side cross-sectional view of a polishing station, according to one embodiment.

FIG. 8A is a schematic side cross-sectional view of a polishing station 800. The polishing station 800 is similar to the polishing station 700 of FIG. 7, but the head actuation assembly 505 is replaced with the head actuation assembly 804. The polishing station 800 may used in place of one of the polishing stations 200, 300, 400 of FIGS. 2A-4C. In some embodiments, the polishing station 800 may be integrated within the polishing stations 200, 300, 400 of FIGS. 2A-4C, such that the polishing station 800 is one or more of the polishing modules 250*a*, 250*b*, 250*c*, 250*d*, 350*a*, 350*b*, 350*c*, 350*d*, 450*a*, 450*b*, 450*c* and are stacked. The head actuation assembly 804 includes both of the first head assembly 504*a* and the second head assembly 504*b*. The first head assembly 504*a* and the second head assembly 504*b* are each individually coupled to an arm support 814*a*, 814*b*. The arm support 814*a*, 814*b* may be a single arm support which extends outward from a central rotation shaft 812 or multiple arm supports 814*a*, 814*b* extending outward from the central rotation shaft 812. In some embodiments, a different arm support 814*a*, 814*b* is present for each of the head assemblies 504*a*, 504*b*. The first head assembly 504*a* is supported by a first arm support 814*a* while the second head assembly 504*b* is supported by a second arm support 814*b*.

The polishing station 800 may further include liquid delivery and conditioning arms disposed on the head actuation assembly 804, such that the liquid delivery and conditioning arms are coupled to separate guide rails along a central rail support 806. The liquid delivery and conditioning arms are similar to the liquid delivery arms 302 and the pad conditioner arms 310 of FIGS. 3A-3C. The pad conditioner arms 310 may also be similar to the pad conditioner 720 of FIG. 7.

The central rotation shaft 812 is disposed between the first head assembly 504*a* and the second head assembly 504*b*. The central rotation shaft 812 is configured to enable the first head assembly 504*a* and the second head assembly 504*b* to be rotated about a central axis 820. Rotating the first head assembly 504*a* and the second head assembly 504*b* around the central axis 820 enables the positions of the first head assembly 504*a* and the second head assembly 504*b* to be switched, such that the first head assembly 504*a* is disposed over the second platen 738*b* and the second head assembly 504*b* is disposed over the first platen 738*a*. Therefore a substrate held by one of the head assemblies 504*a*, 504*b* is able to be efficiently moved to any one of a plurality of pads, such as one of the pads 236*a*, 236*b*, 708*a*, 708*b*, of the polishing station 800. Arm supports 814*a*, 814*b* may also be utilize to support one or more liquid delivery units, liquid deliver arms, or conditioner arms.

The central rotation shaft 812 is mechanically coupled and extends downward from a linear actuator 810. The linear actuator 810 is similar to the linear actuator 508 or the linear conditioner actuator 716. The linear actuator 810 is configured to move along one or more rails 808 which are coupled to a central rail support 806. The central rail support 806 is coupled to or a part of the upper inner sidewall 202A of the system body 202. The rails 808 are disposed on a bottom surface of the central rail support 806. The rails 808 and the central rail support 806 extend along a length of the polishing station 800, such that the head assemblies 504*a*, 504*b* can be actuated over a desired area off each of the pads 236*a*, 236*b*, 708*a*, 708*b*.

Figure 8B:
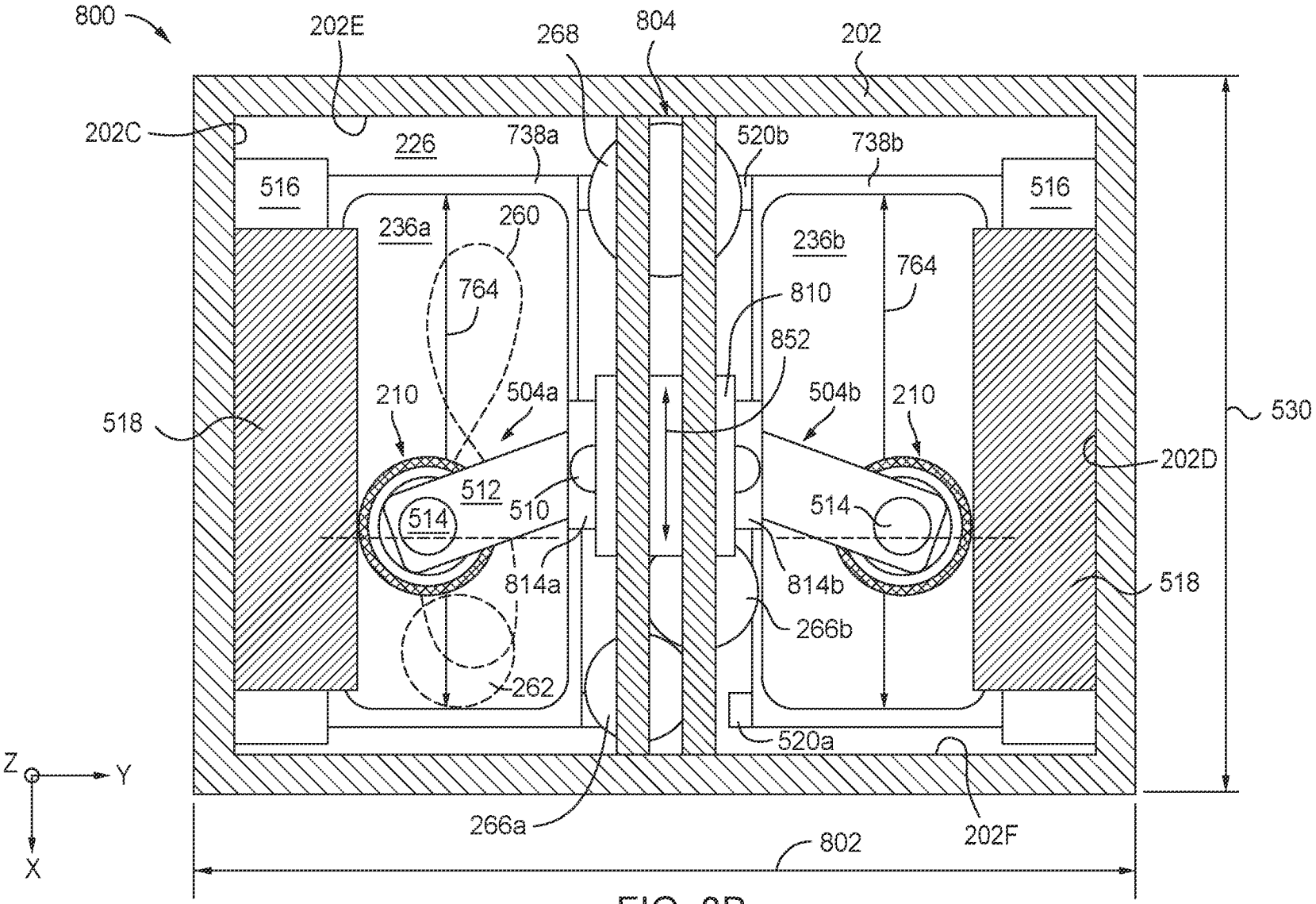
FIG. 8B is a schematic top partial cross-sectional view of the polishing station of FIG. 8A, according to one embodiment.

FIG. 8B is a schematic top partial cross-sectional view of the polishing station 800 of FIG. 8A. The rails 808 are shown to extend from one side of the system body 202 to the opposite side of the system body 202. The linear actuator 810 is configured to move in a lengthwise direction 852. The polishing station 800 of FIGS. 8A and 8B have similar benefits to the polishing station 700 of FIG. 7, but further reduce the number of rails such that only one set of rails 808 are utilized. This is enabled by utilizing a rotating central rotation shaft 812. The central rotating shaft 812 further enables simultaneous movement of both of the head assemblies 504*a*, 504*b* and reduces the mechanical complexity to improve servicing of the polishing station 800.

Figure 9A:
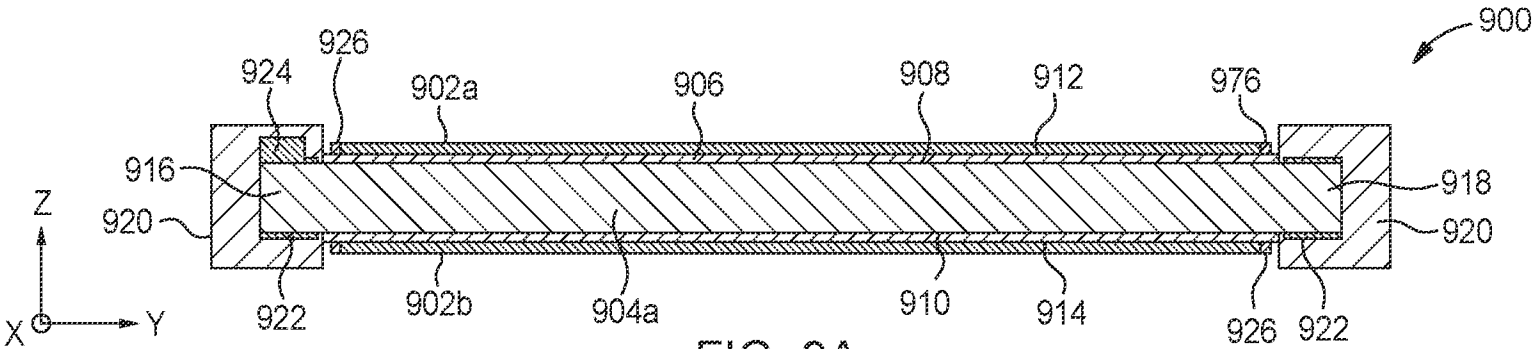
FIGS. 9A and 9B are schematic views of a multi-pad platen assembly, according to one embodiment.
Figure 9B:
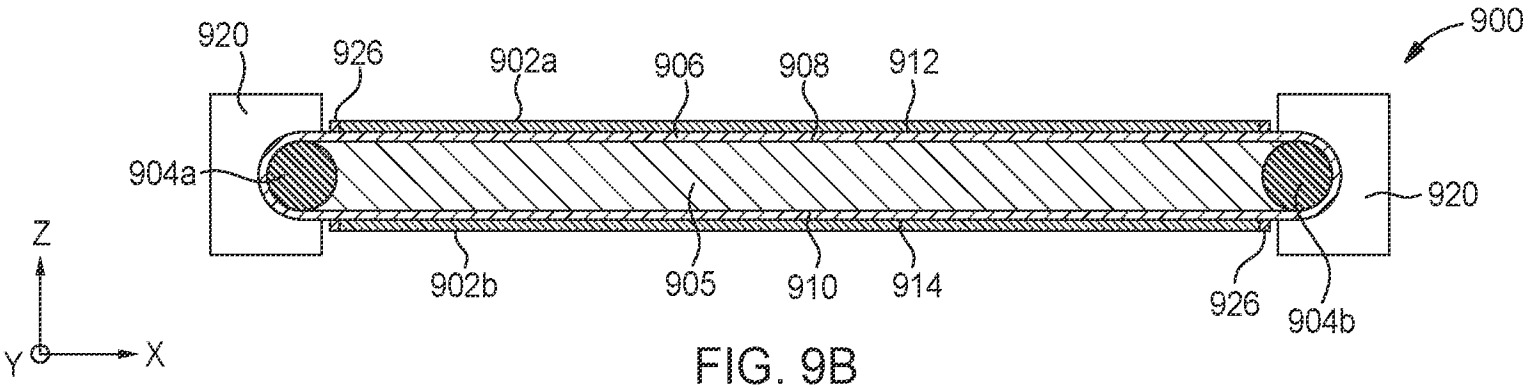

FIGS. 9A and 9B are schematic views of a multi-pad platen assembly 900. The multi-pad platen assembly 900 may be used in place of either of the multi-pad platen assembly 405 or the multi-pad platen assembly 750 of FIGS. 4A-4C, 7, and 8. The multi-pad platen assembly 900 is an exemplary embodiment that includes a plurality of pads that may be indexed within a polishing station or a polishing module. The multi-pad platen assembly 900 includes a platen 905, a first roller 904*a* disposed on a first side of the platen 905, a second roller 904*b* disposed on a second side of the platen 905, a platen support 920 disposed on both sides of the platen 905, a belt 906 disposed around the platen 905 and the rollers 904*a*, 904*b*, and pad stops 926.

The platen 905 is formed of a metal material and may include one or more sub-layers (e.g., coating or removable plate) for supporting the pads 902*a*, 902*b* to further minimize wear and allow the movement of the belt 906 relative to the platen 905. The platen 905 may have grooves disposed on opposite ends thereof where the rollers 904*a*, 904*b* are positioned. The grooves are configured to reduce the gap over which the belt 906 travels when stretching between the platen 905 and the rollers 904*a*, 904*b*. As shown in FIG. 9A, a first end 916 of the first roller 904*a* is disposed within an opening within a first platen support 920 while a second end 918 of the first roller 904*a* is disposed within an opening within a second platen support 920. A bearing 922 is disposed between the first roller 904*a* and each of the platen supports 920 to enable rotation of the first roller 904*a*. A motor 924 may be coupled to one of the first end 916 or the second end 918 of the first roller 904*a* and is disposed within the first platen support 920 to produce rotation of the first roller 904*a*. In some embodiments, a motor 924 is disposed within both of the first platen support 920 and the second platen support 920 and coupled to both the first end 916 and the second end 918 to reduce strain on a single motor 924. The second roller 904*b* is disposed within the platen supports 920 in a similar way as the first roller 904*a*.

One or more pad stops 916 are disposed around a silhouette of where a pad is configured to be positioned. The one or more pad stops 916 may be one pad stop 916 which is configured to surround an entirety of a polishing pad or a plurality of discreet pad stops 916 positioned at various positions around a perimeter of a polishing pad, such as the polishing pads 902*a*, 902*b*. The pad stops 916 may be slight protrusions extending outward from the belt 906 or may be grooves within the belt 906.

As shown in FIG. 9B, the belt 906 is wrapped around the polishing platen 905, such that the belt 906 contacts a first surface 908 and a second surface 910 opposite the first surface 908. The belt 906 includes a first pad support surface 912 and a second pad support surface 914. The first pad support surface 912 is the location on which the first pad 902*a* is disposed. The second pad support surface 914 is the location on which the second pad 902*b* is disposed. The first pad support surface 912 and the second pad support surface 914 are configured to actuate over each of the first roller 904*a* and the second roller 904*b* when the pads 902*a*, 902*b* are being indexed from one side of the platen 908, 910 to an opposite side of the platen 908, 910.

Figure 10:
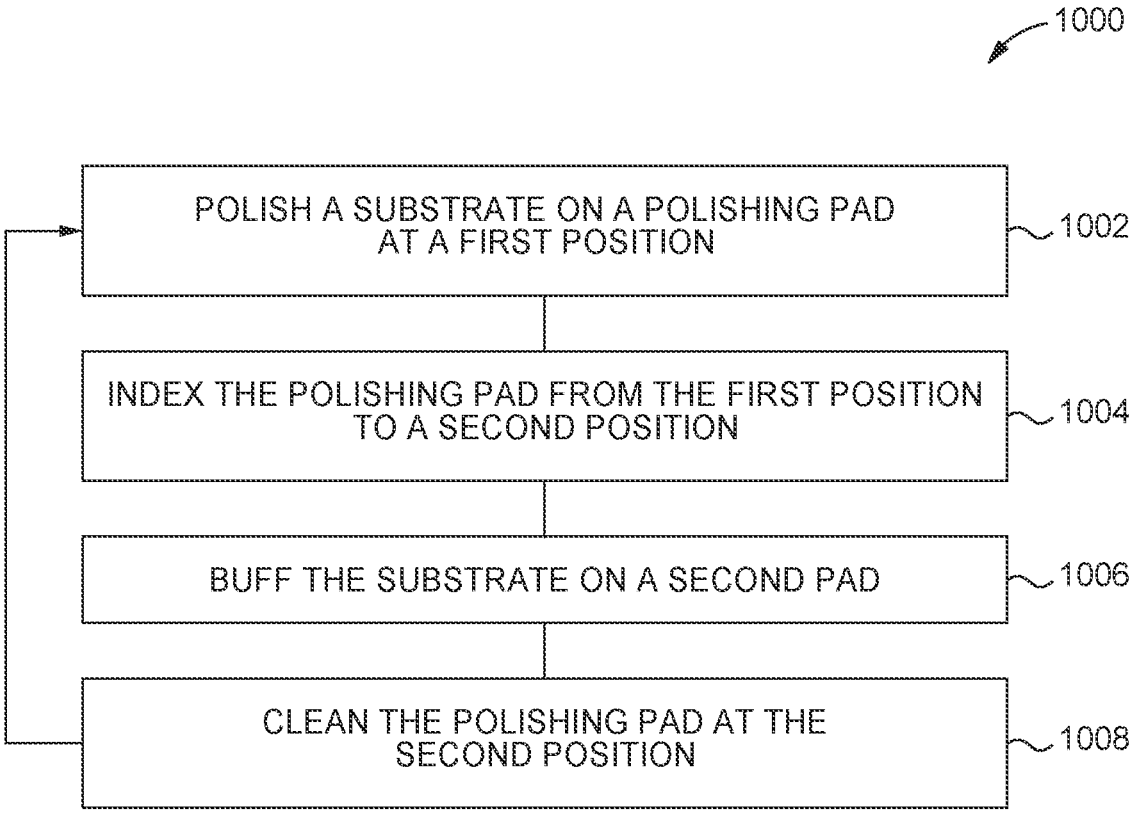
FIG. 10 is a flow diagram illustrating a method of utilizing a polishing pad, according to embodiments described herein.

FIG. 10 is a flow diagram illustrating a method 1000 of utilizing one or more polishing pads during a substrate polishing sequence. The polishing pads used in method 1000 may be any one of the pads 236*a*, 236*b*, 406*a*, 406*b*, 708*a*, 708*b* of the embodiments described herein. During the method 1000, a substrate is being polished on a first polishing pad while the first polishing pad is held at a first position during an operation 1002. The first position is a stationary position, such that the first polishing pad does not move. The first position is an upward facing position, such that the first polishing pad is disposed facing one or more carrier head assemblies, such as the carrier head assemblies 210.

While in the first position, the substrate is driven against the first polishing pad and actuated in pre-determined pattern to polish the substrate. In some embodiments, the operation 1002 is a buff operation instead of the polishing operation, such that the polishing pad is a buff pad and provided fluids enable a buffing process. In other embodiments, the operation 1002 is a polishing operation instead of the buffing operation, such that the first polishing pad is a polishing pad. During processing, the substrate is moved over the first pad in a pre-determined pattern and at a pre-determined speed to obtain a desired polish profile. As the substrate is actuated over the first polishing pads, the substrate may be moved in a leminiscate path to assure uniform removal of material across a surface of the substrate. A slurry or other polishing fluid may be dispensed onto the polishing pad during the operation 1002. In some embodiments, a conditioning disk may also be used during the operation 1002 to condition the polishing pad on which the substrate is being processed.

After using the first polishing pad to polish the substrate during the operation 1002, the polishing pad is indexed from the first position to a second position during an operation 1004. The second position is a position on an opposite side of a platen, such as one of the platens 404, 738*a*, or 738*b*. The second position is facing one or more pad wash stations, such as one of the pad wash stations 410, 702*a*, 702*b*. Indexing the first polishing pad includes moving the polishing pad using one or more belts, such as one of the belts 770, 906 or the belt of FIGS. 4A-4C. In some embodiments, the first polishing pad is coupled to a belt which wraps around the platen. One or more rollers may be configured to move the belt and the polishing pad.

Once the first polishing pad is in the second position, a second polishing pad is disposed in the first position as the second polishing pad is on the opposite side of the belt. The second polishing pad may be any one of the pads 236*b*, 406*a*, 406*b*, 708*a*, 708*b*. In some embodiments, the second polishing pad is utilized to buff the substrate during an operation 1006 and therefore may be a buff pad. In other embodiments, the operation 1006 is a polishing operation instead of the buffing operation, such that the second polishing pad is a standard polishing pad. Similarly to operation 1002, the substrate is moved over the second polishing pad in a pre-determined pattern and at a pre-determined speed to obtain a desired substrate profile. As the substrate is actuated over the second polishing pad, the substrate may be moved in a leminiscate path. One or more fluids may optionally be dispensed onto the buff pad during the operation 1006.

Once the first polishing pad is in the second position, the first polishing pad is cleaned during an operation 1008. The operation 1008 includes spraying a cleaning fluid onto the polishing pad such as water. A conditioning disk, such as one or more of the pad conditioners 214 or 720, is also utilized to condition the first polishing pad during the operation 1008. The pad wash station further includes one or more additional brushes for removal of slurry and contaminants from the first polishing pad. The upside-down orientation of the first polishing pad further assists in the removal of slurry and other contaminants and anything on the polishing pad would fall away from the first polishing pad when knocked loose.

After cleaning the first polishing pad, the method 1000 is repeated. When repeating the method 1000 either a new substrate or the same substrate may be utilized. In embodiments in which the same substrate is being processed, the head holding the substrate may hold the substrate during indexing of the polishing pads and set the substrate back down on the polishing pads without releasing the substrate or grabbing a new substrate. In some embodiments, there are one or more intermediate operations wherein the second polishing pad and/or a buff pad is cleaned similarly to the first polishing pad.

Benefits of the present disclosure include the ability to form a more modular and compact polishing station. In some embodiments, the polishing stations described herein may perform up to four different process operations within a single module. The use of simultaneous polishing of a substrate and washing of a pad enables reduced overhead time. The pad wash and head wash may also be improved by increasing the wash times of both components.

While the foregoing is directed to embodiments of the present disclosure, other and further embodiments of the disclosure may be devised without departing from the basic scope thereof, and the scope thereof is determined by the claims that follow.

What is claimed is:

1. A substrate polishing system, comprising:

a plurality of polishing stations that are positioned in a stacked orientation, wherein each of the polishing stations comprise:

a system body that includes one or more walls that define a processing region;

a platen disposed within the processing region of the system body having a rectangular pad supporting surface that is configured to receive a non-axisymmetric polishing pad, wherein a long side of the rectangular pad supporting surface is aligned in a first direction; and a head assembly disposed over the pad supporting surface of the platen, and wherein the head assembly comprises:

a carrier head disposed over the pad supporting surface of the platen;

a linear actuator connected to a central rail support; and a support arm that couples the carrier head to the linear actu ator, wherein the linear actuator is configured to position the carrier head and support arm in the first direction.

2. The substrate polishing system of claim 1, wherein the processing region of each of the plurality of polishing stations that are stacked vertically are functionally isolated from each other.

3. The substrate polishing system of claim 2, wherein the platen comprises a first platen, and the substrate polishing system further comprises: a second platen disposed within the system body having a rectangular pad supporting surface that is configured to receive a non-axisymmetric polishing pad, wherein a long side of the rectangular pad supporting surface of the second platen is aligned in the first direction.

4. The substrate polishing system of claim 3, wherein the first platen and the second platen each have a length and a width with an aspect ratio of greater than 2:1.

5. The substrate polishing system of claim 3, further comprising: a first pad drive unit configured to index the first non-axisymmetric polishing pad disposed on a first side of the first platen to a second side of the first platen opposite the first side; a second pad drive unit configured to index a second non-axisymmetric polishing pad disposed on a first side of the second platen to a second side of the second platen opposite the first side of the second platen; and a pad washing module, which comprises one or more fluid nozzles, is disposed on the second side of the first platen or the second side of the second platen.

6. The substrate polishing system of claim 1, further comprising: a pad drive unit configured to index a first non-axisymmetric polishing pad disposed on a first side of the platen to a second side of the platen opposite the first side, wherein the carrier head is positioned over the first side of the platen that comprises the pad supporting surface; and a pad washing module, which comprises one or more fluid nozzles, is disposed on the second side of the platen.

7. The substrate polishing system of claim 6, wherein a pad conditioner is disposed on the second side of the platen.

8. The substrate polishing system of claim 1, further comprising: a pad conditioner is disposed on a conditioning side of the platen that is opposite to a polishing side of the platen, wherein the polishing side of the platen includes the rectangular pad supporting surface; a linear conditioner actuator; and a connecting arm that is coupled between the linear conditioner actuator and the pad conditioner, wherein the linear conditioner actuator is configured to position the pad conditioner and connecting arm in the first direction.

9. The substrate polishing system of claim 1, wherein the plurality of polishing stations comprises two polishing stations that include processing regions that are stacked vertically and are fluidly isolated from each other.

10. The substrate polishing system of claim 9, wherein the two polishing stations have a height of less than 1000 mm and a width of less than 2500 mm.

11. The substrate polishing system of claim 1, wherein the linear actuator is the only means to generate relative motion between the carrier head and a non-axisymmetric polishing pad disposed on the rectangular pad supporting surface.

* * * * *